US006931996B2

(12) United States Patent
Matsukawa

(10) Patent No.: US 6,931,996 B2
(45) **Date of Patent: *Aug. 23, 2005**

(54) CONVEYANCE SYSTEM

(75) Inventor: Kazufumi Matsukawa, Komaki (JP)

(73) Assignee: Daifuku Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/636,443

(22) Filed: Aug. 6, 2003

(65) Prior Publication Data

US 2004/0025739 A1 Feb. 12, 2004

Related U.S. Application Data

(63) Continuation of application No. 09/940,124, filed on Aug. 27, 2001, now Pat. No. 6,629,502.

(30) Foreign Application Priority Data

Sep. 14, 2000 (JP) ..... 2000-279001
Sep. 14, 2000 (JP) ..... 2000-279002

(51) Int. Cl.[7] ..... B61B 12/02
(52) U.S. Cl. ..... 104/96; 104/130.1
(58) Field of Search ..... 104/280, 139, 104/140, 245, 287, 172.4, 137, 130.09, 96, 130.11, 130.07, 130.01, 103

(56) References Cited

U.S. PATENT DOCUMENTS

| | | | | | |
|---|---|---|---|---|---|
| 3,098,454 | A | * | 7/1963 | Maestrelli | 104/247 |
| 3,783,793 | A | * | 1/1974 | Perrott et al. | 104/130.01 |
| 3,811,383 | A | * | 5/1974 | Butzow | 104/130.01 |
| 3,835,785 | A | * | 9/1974 | Kirschner et al. | 104/130.01 |
| 3,841,225 | A | * | 10/1974 | Johnson | 104/130.01 |
| 3,845,719 | A | * | 11/1974 | Langdon | 104/130.07 |
| 3,901,160 | A | * | 8/1975 | Auer, Jr. | 104/130.07 |
| 3,946,974 | A | | 3/1976 | Stiefel et al. | 104/130 |
| 3,972,293 | A | * | 8/1976 | Watts | 104/130.01 |
| 4,000,700 | A | | 1/1977 | Hannover et al. | 104/130 |
| 4,224,875 | A | * | 9/1980 | Knippel et al. | 104/130.01 |
| 4,671,185 | A | | 6/1987 | Anderson et al. | 104/130 |

FOREIGN PATENT DOCUMENTS

| | | |
|---|---|---|
| JP | 8-332947 | 12/1996 |
| JP | 8-332948 | 12/1996 |
| JP | 9-221023 | 8/1997 |
| JP | 10-111719 | 4/1998 |
| JP | 10-207543 | 8/1998 |
| JP | 11-168805 | 6/1999 |
| JP | 11-222122 | 8/1999 |
| JP | 2000-059921 | 2/2000 |
| JP | 2000-059922 | 2/2000 |
| JP | 2000-152403 | 5/2000 |

* cited by examiner

*Primary Examiner*—Frantz F. Jules
(74) *Attorney, Agent, or Firm*—Kusner & Jaffe

(57) ABSTRACT

A pair of rail members have upward wheel supporting surfaces and inward roller guide surfaces, respectively. A fixed path includes linear path portions and a branching-and-joining path portion. Linear-side guide members extending along the linear path portions and a branching-and-joining-side guide member extending along the branching-and-joining path portion are provided in a branching-and-joining section. A moving body is provided with wheels and side guide rollers supported and guided on a wheel supporting surface and a roller guide surface, respectively. A direction restricting member guided by sideward guide sections of the guide members is driven by a lateral-movement unit to move freely in a lateral direction between a location corresponding to the linear-side guide member and a location corresponding to the branching-and-joining-side guide member. The linear path portions and the branching-and-joining path portion may be formed with the rail apparatuses in which dust or the like is unlikely to collect. With a simple structure added to the rail apparatus arranged in the branching-and-joining section, branching and juncture can be achieved without any limitations to the layout and effective and flexible conveyance enabled.

9 Claims, 19 Drawing Sheets

CONVEYANCE SYSTEM

RELATED APPLICATIONS

This application is a continuation of U.S. application Ser. No. 09/940,124, filed Aug. 27, 2001, now U.S. Pat. No. 6,629,502, and hereby incorporated herein by reference.

FIELD OF THE INVENTION

The present invention relates to a conveyance system for use in conveying various articles while supporting them.

BACKGROUND OF THE INVENTION

As such a conveyance system, for example, the configuration disclosed in Japanese Patent Laid-Open No. 10-111719 is conventionally provided. This conventional configuration is provided with conveying trucks supported and guided along a main track and a branching track. Each of the tracks comprises a bottom wall, a right and a left side walls, and a top wall, and is shaped like a duct by forming a slit in a width-wise center of the top wall, a slit extending along a longitudinal direction. At least at a branching point, a guide along the main track and a guide along the branching track are provided. Further, the conveying trucks are each provided with a guide member following the guides and a directing mechanism for directing the guide member to one of the guides.

The guides comprise guide rails made of a magnetic body and extending along the main track and the branching track, respectively. The guide member comprises a magnetic roller which is directed to either one of the guide rails via an arm or the like.

With the above conventional form, however, the main and branching tracks must be provided with separate guide rails made of a magnetic body. This is cumbersome in assembling or constructing this form. Further, since the main and branching tracks are shaped like ducts, dust or the like collects on the bottom walls of the tracks, which cannot be cleaned easily. Accordingly, it is not easy to employ this conventional form cannot for clean rooms, where clean air is blown downward.

Furthermore, layouts that enable branching and juncture are limited. For example, it is difficult to provide a layout in which the tracks extend in parallel and in which the conveying trucks are shifted between the tracks. As a construction in which the conveying trucks are shifted between the tracks, a swinging table form disclosed in Japanese Patent Laid-Open No. 11-222122 is provided. This invention, however, requires a complicated structure and also requires the conveying truck to stop running between the tracks.

Further, since the main and branching tracks are shaped like ducts, for example, formation of a loop line requires separate exclusive parts to be prepared for a linear portion and a curve portion. In particular, the track of the curve portion is expensive.

DISCLOSURE OF THE INVENTION

A first object of the present invention is to provide a conveyance system constructed so that linear path portions and a branching-and-joining path portion are formed by rail apparatuses in which dust or the like is difficult to collect, wherein a simple structure is added to the rail apparatus arranged in a branching-and-joining section to achieve branching and juncture without any limitations on the layout, thereby realizing effective and flexible conveyance.

A second object of the present invention is to provide a conveyance system constructed so that a fixed path and a branching-and-joining path are formed by rail apparatuses in which dust or the like is difficult to collect, wherein moving bodies can be smoothly moved between the fixed path and the branching-and-joining path for branching and juncture, and wherein curve portions can be formed easily.

To attain the first object, the present invention provides a conveyance system comprising rail apparatuses and moving bodies which are supported and guided by the rail apparatuses so as to move freely on a fixed path, characterized in that: each of the rail apparatuses comprises a lateral pair of rail members each having an upward wheel supporting surface and an inward roller guide surface formed thereon; the fixed path comprises linear path portions and a branching-and-joining path portion; a branching-and-joining section formed by said path portions are provided with linear-side guide members extending along the linear path portions and a branching-and-joining-side guide member extending along the branching-and-joining path portion; and the moving bodies are each provided with wheels supported and guided on the wheel supporting surface, side guide rollers guided on the roller guide surface, and a direction restricting member guided by sideward guide sections of the guide members, the direction restricting member being driven by lateral-movement means to move in a lateral direction between a location corresponding to the linear-side guide member and a location corresponding to the branching-and-joining-side guide member.

With the above configuration of the present invention, the moving bodies can be stably moved and guided by the rail apparatus by supporting and guiding the group of wheels on the wheel supporting surface so as to roll thereon and guiding the side guide roller on the roller guide surface. In this case, the rail apparatus may have a space formed between the lateral pair of rail members along the entire length thereof, and a vertical-penetration portion formed by this space allows air to flow without being hindered, thereby enabling this conveyance system to be suitably employed even for clean rooms where clean air is blown downward.

When the moving body on the linear path portion is moved thereon without being branched or joined to the branching-and-joining path portion, the lateral-movement means may be used to move the direction restricting member away from the branching-and-joining path portion. Then, the direction restricting member can be guided by the guide section of the linear-side guide member, and the moving body can be stably moved straight by the linear path portion without moving into the branching-and-joining path portion.

On the other hand, when the moving body on the linear path portion is branched and joined to the branching-and-joining section, the lateral-movement means may be used to move the direction restricting member to the branching-and-joining path portion. Then, the direction restricting member can be guided by the guide section of the branching-and-joining-side guide member, and the moving body can be branched and moved smoothly and reliably to the branching-and-joining path portion.

In the branching-and-joining section, one of the wheels, rolling on the wheel supporting surface of the rail members, is rolled so as to move across the space between the rail members. Accordingly, this wheel falls into the space, and the weight of the moving body serves to generate a moment around the wheel on the other wheel supporting surface, thus inclining the moving body. At this time, the direction restricting member is guided by the sideward guide member, so that the moment on the moving body can be accommodated to restrict the direction of the moving body, while hindering its inclination. As a result, the above wheel can move across the space stably without falling into it.

As described above, according to the present invention, the conveyance system is constructed so that the linear path portions and the branching-and-joining path portion are formed by the rail apparatus in which dust or the like is difficult to collect, but the simple structure is added to the rail apparatus arranged in the branching-and-joining section to realize branching and juncture without any limitations to the layout, thereby achieving effective and flexible conveyance.

According to a first embodiment of the conveyance system of the present invention, the branching-and-joining path portion is arranged between a pair of parallel linear path portions, linear-side guide members of both linear path portions have linear guide sections formed outside parallel portions of the linear-side guide members and a branching-and-joining guide sections formed inside the parallel portions, the branching-and-joining-side guide member comprises a branching-side guide member and a joining-side guide member which are severed from each other, and a branching-side guide section and a joining-side guide section which are extended from the branching-and-joining-side guide member are formed to extend in different directions, and there is a severed section in which the direction restricting member moved along the branching-side guide section is guided to the joining-side guide section.

According to the first embodiment, when the moving body is moved along the linear path portion without being branched or joined to the branching-and-joining path portion, the direction restricting member is guided by the linear-side guide section of the linear-side guide member, thereby enabling the moving body to move straight along the linear path portion.

On the other hand, when the moving body on one of the linear path portions is branched and joined to the branching-and-joining path portion, it can be moved to the branching-and-joining path portion for juncture by guiding the direction restricting member of the moving body from the branching-and-joining-side guide section of the linear-side guide member to the branching-side guide section of the branching-side guide member. Then, when the direction restricting member is guided by the branching-side guide section, the moving body can be moved to the other linear path portion by allowing the direction restricting member to be guided by the joining-side guide section of the joining-side guide member and then guiding the direction restricting member to the branching-and-joining-side guide section of the linear-side guide member.

Thus, the moving body can be shifted smoothly and reliably between the parallel linear path portions, thus achieving branching and juncture with lesser limitations to the layout.

According to a second embodiment of the conveyance system of the present invention, the direction restricting member is provided via a support so as to move freely in the lateral direction, and lateral-movement means comprises a driving section and a drive transmitting section for moving the support in the lateral direction in response to forward and backward driving effected by the driving section, the drive transmitting section including a device for connecting or disconnecting a transmission path.

According to the second embodiment, the direction restricting member can be moved in the lateral direction by causing the driving section of the lateral-movement means to effect the forward and backward driving so as to cause the connecting and disconnecting device to move the support in the lateral direction via the drive transmitting section in a connected state. In this manner, the transmission path can be made free by moving the direction restricting member in the lateral direction and then disconnecting the connecting and disconnecting device. Accordingly, while the direction restricting member is being guided by the guide members, the lateral movement of the direction restricting member need not be controlled. Consequently, the direction restricting member can be moved smoothly in the lateral direction together with the support.

According to a third embodiment of the conveyance system of the present invention, attracting means is provided for holding the support which has reached a lateral-movement limit location.

According to the third embodiment, after the lateral movement, the support can be held (locked) at the lateral-movement limit location through an attracting action effected by the attracting means. By automatically clearing the attraction effected by the attracting means, the direction restricting member can be smoothly guided and moved by the guide member in the lateral direction together with the support.

To attain the above described second object, the present invention provides a conveyance system comprising rail apparatuses and moving bodies which are supported and guided by the rail apparatuses so as to move freely on a fixed path, characterized in that: the rail apparatuses each comprises a lateral pair of rail members disposed to form a space therebetween, the rail members being each formed with an upward wheel supporting surface and an inward roll guide surface; in a branching-and-joining section leading to the branching-and-joining path which is branched and joined with respect to the fixed path, one of the lateral pair of rail members which is located on the side of the branching-and-joining path is severed to leave a space, and the rail members on the side of the branching-and-joining path are disposed to be contiguous to each severed end; the branching-and-joining section includes a fixed-path-side guide member extending along the fixed path and a branching-and-joining-side guide member extending along the branching-and-joining path; each of the moving bodies includes wheels supported and guided on the wheel supporting surface, side guide rollers guided on the roller guide surface, and a direction restricting member guided by sideward guide sections of the guide members; the direction restricting member is driven by lateral-movement means to move freely in a lateral direction between a location corresponding to the fixed-path-side guide member and a location corresponding to the branching-and-joining-side guide member; and the wheel on the side of the space floats over the wheel supporting surface when the direction restricting member is being guided by the guide member in the branching-and-joining section.

With the above configuration of the present invention, the moving bodies can be stably moved and guided by the rail apparatuses by supporting and guiding the group of wheels on the wheel supporting surface to roll thereon and guiding the side guide roller on the roller guide surface. In this case, the rail apparatus can form a space between the lateral pair of rail members along the entire length thereof, and a vertical-penetration portion formed by this space allows air to flow without being hindered, thereby enabling this conveyance system to be suitably employed even for clean rooms where clean air is blown downward.

Furthermore, the lateral pair of rail members are simple and small enough to be bent with ease to have a minimum cross section required for a functional purpose of the conveyance system. Consequently, no specific rail members are required as rail members for curve paths, but linear rail members can be bent and used for the curve paths, thereby reducing the weight of the entire rail apparatuses and substantially reducing costs.

When the moving body on the fixed path portion is moved without being branched to the branching-and-joining path portion, lateral-movement means may be used to move the direction restricting member away from the branching-and-joining path portion. Then, the direction restricting member can be guided by the guide section of the fixed-side guide member, and the moving body can be stably moved straight along the fixed path without moving into the branching-and-joining path portion.

On the other hand, when the moving body on the fixed path is branched and joined to the branching path or the joining path, the lateral-movement means may be used to move the direction restricting member to the branching-and-joining path. Then, the direction restricting member can be guided by the guide section of the branching-and-joining-side guide member, and the moving body can always be moved smoothly and reliably from the fixed path to the branching path for branching or from the joining path to the fixed path.

Furthermore, in the branching-and-joining section, one of the wheels, rolling on the wheel supporting surface of the rail member, is rolled to move across the space between the rail members. Accordingly, this wheel falls into the space, and the weight of the moving body serves to generate a moment around the wheel on the other wheel supporting surface, thus inclining the moving body. At this time, the direction restricting member is guided by the sideward guide member of the branching-and-joining-side guide member, so that the wheel in the space can be floated over the wheel supporting surface. Consequently, the moment on the moving body can be accommodated to restrict the direction of the moving body, while hindering its inclination. As a result, the above wheel can move across the space stably without falling into it.

As described above, according to the present invention, the conveyance system is configured so that the linear path portions and the branching-and-joining path portion are formed by the rail apparatus in which dust or the like is difficult to collect, but the simple structure is added to the rail apparatus arranged in the branching-and-joining section to realize branching and juncture without any limitations to the layout, thereby achieving effective and flexible conveyance.

According to a preferred embodiment of the conveyance system of the present invention, the wheel on the side opposite to the space is supported on the wheel supporting surface, and the direction restricting member is guided by the guide member. Consequently, the moving body is inclined in the lateral direction to cause the wheel on the side of the space to float over the wheel supporting surface.

According to this preferred embodiment, the wheel on the side opposite to the space is supported on the wheel supporting surface, and the direction restricting member is guided by the sideward guide section of the branching-and-joining-side guide member. Accordingly, the moving body is guided while being supported at two points, thereby enabling the wheel on the side of the space to float over the wheel supporting surface, while allowing the downward moment on the moving body to be accommodated.

According to another preferred embodiment of the conveyance system of the present invention, at least a portion of the guide member is formed to be thick enough to receive the moving body while inclining it in the lateral member.

According to this preferred embodiment, with a simple construction in which the guide member has a thickened portion formed therein (a simple construction in an improved form), the moving body can be received while being inclined in the lateral direction, and a sufficient receiving strength is ensured.

DESCRIPTION OF THE EMBODIMENTS

Figure 1:
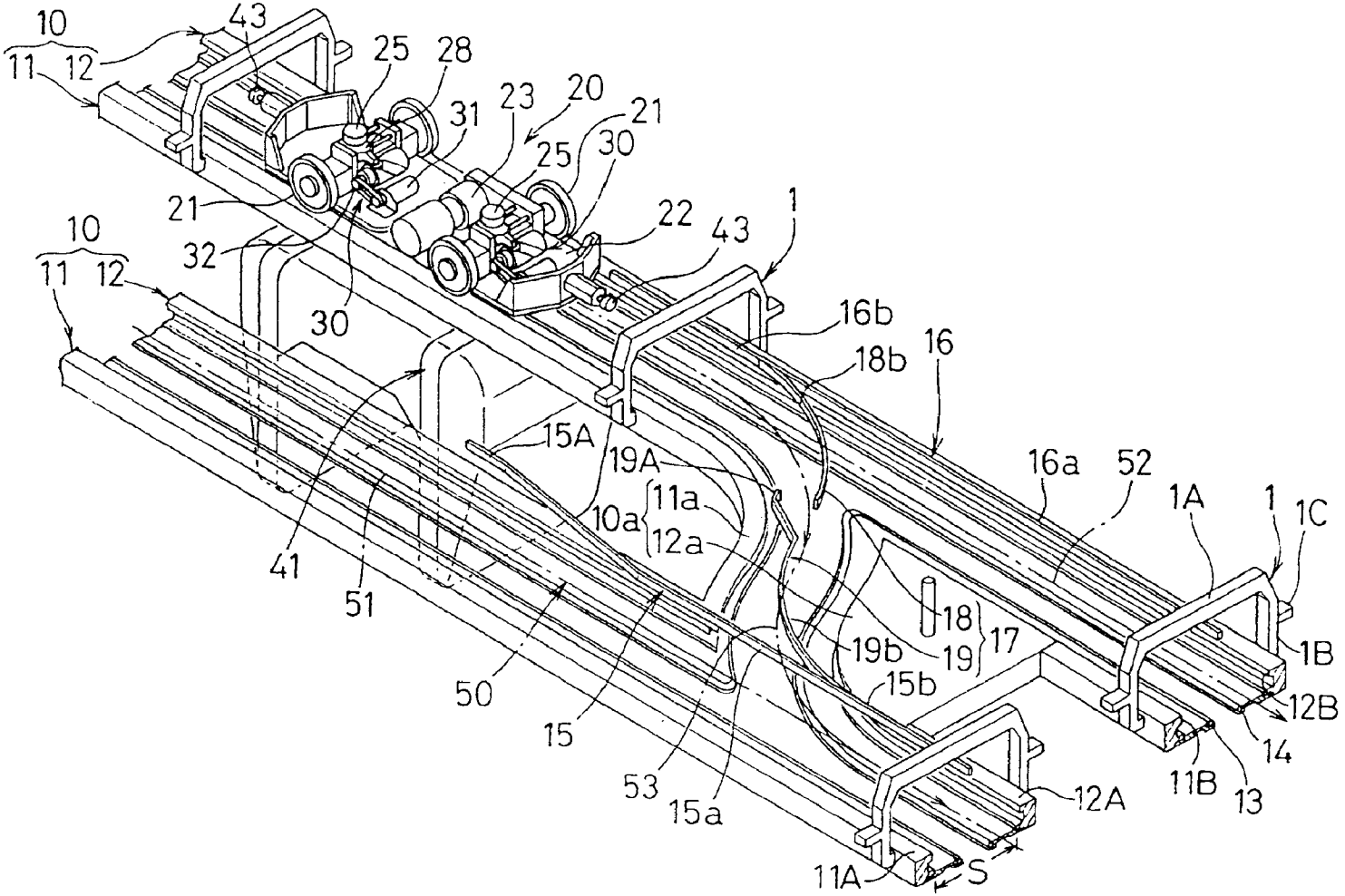
FIG. 1 is a perspective view of a branching-and-joining section of a conveyance system according to a first embodiment of the present invention.

A first embodiment of the present invention will be described below with reference to FIGS. 1 to 8.

In FIGS. 1 to 5, a rail apparatuses 10 each comprise a lateral pair of rail members 11 and 12 that are shaped like bars obtained by extruding aluminum and that are disposed linearly symmetrically (linearly symmetrically). The rail members 11 and 12 have top surfaces (upper surfaces) forming upward-facing wheel supporting surfaces 11A and 12A, respectively, and upper inward-facing surfaces forming roller guide surfaces 11B and 12B, respectively. Furthermore, the rail members 11 and 12 have outward-facing horizontal dove-tail groove portions 11C and 12C and downward-facing downward dove-tail groove portions 11D and 12D formed therein.

The rail members 11 and 12 are supported on a ceiling beam 2 via a plurality of rail yokes 1 spaced at predetermined intervals. That is, the rail yokes 1 each have a top plate portion 1A, side plate portions 1B extending downward from neighborhoods of opposite ends of the top plate portion 1A, and junctions 1C each projected outward of an intermediate outer surface of the side plate portion 1B. The rail yoke 1 is integrally formed like a gate as viewed in a front view.

The rail yoke 1 is supported on the ceiling beam 2 via connection members 3 (bolts, nuts, or the like) on which the junctions 1C act, so that the height and position of the rail yoke 1 can be adjusted. Outer surfaces of the rail members 11 and 12 are pressed against corresponding lower inner surfaces of the side plate portions 1B to connect the rail yoke 1 to the rail members 11 and 12 via connection members 4 that use the horizontal dove-tail grooves 11C and 12C. Thus, the rail members 11 and 12 are disposed with a predetermined slit S formed therebetween.

The rail apparatus 10, comprising the lateral pair of rail members 11 and 12 as described above, forms a fixed path 50. The fixed path 50 is formed by a pair of parallel linear path portions 51 and 52 and a branching-and-joining path portion 53 arranged between these linear path portions 51 and 52. In the branching-and-joining path portion 53, the lateral pair of rail members 11 and 12 in the branching-and-joining path portion 53 is connected to the lateral pair of rail members 11 and 12 on either side.

That is, the lateral pair of rail members (hereinafter referred to as the "lateral pair of rail members 11*a* and 12*a*) having the same sectional shape as the above described rail members 11 and 12 are also disposed on the branching-and-joining path portion 53 to constitute a rail apparatus 10*a*. The rail member 11*a*, located in the direction of a branching path, is formed to start with a portion forming the linear path portion 52, bent toward the linear path portion 51 in the branching-and-joining path portion 53, and then connect to a cut end of the rail member 12 forming the linear path portion 51.

Further, the other rail member 12*a* is formed to extend along the rail 11*a* but to start with a portion forming the linear path portion 51, bent toward the linear path portion 52 in the branching-and-joining path portion 53, and then connect to a cut end of the rail member 11 forming the linear path portion 52.

A branching-and-joining section formed by the path portions 51 to 53 is provided with linear-side guide members 15 and 16 extending along the linear path portions 51 and 52, respectively, and a branching-and-joining-side guide member 17 extending along the branching-and-joining path portion 53. The guide members 15, 16, and 17 are disposed between the corresponding lateral pairs of rail members 11 and 12, and 11*a* and 12*a* and at upper locations, and are connected to a bottom surface of the top plate portion 1A of the rail yoke 1.

The linear-side guide members 15 and 16 have linear-side guide sections 15*a* and 16*a*, respectively, outside a parallel side and branching-and-joining-side guide sections 15*b* and 16*b*, respectively, inside the parallel side.

Further, the branching-and-joining-side guide member 17 comprises a branching-side guide member 18 and a joining-side guide member 19 which are severed from each other. A branching-side guide section 18*b* and a joining-side guide section 19*b* contiguous to the branching-and-joining-side guide sections 15*b* and 16*b*, respectively, are formed to extend in different directions. Furthermore, in a severed section of the branching-side guide member 18 and the joining-side guide member 19, the joining-side guide member 19 has a free end formed into a receiving section 19A projecting toward an upstream side so that a direction restricting member (described later), moving along the branching-side guide section 18*b*, is guided to the joining-side guide section 19*b*.

The linear-side guide member 15, extending along the linear path portion 51, has a start end position formed into a receiving portion 15A projecting toward the branching-and-joining side so that the arriving direction restricting member is guided to the linear-side guide section 15*a*.

A self-propelled member (one example of a moving body) 20 is provided which is supported and guided by the rail apparatuses 10 so as to move freely on the fixed path 50. The self-propelled member 20 comprises a longitudinal pair of trolley main bodies 22 having wheels 21 supported and guided on the wheel supporting surfaces 11A and 12A, a device 41 provided between lower ends of the trolley main bodies 22 to hold articles to be conveyed, and a travel driving device 23 linked with one of the pairs of wheels.

The trolley main bodies 22 of the self-propelled member 20 are each provided with a longitudinal pair of side guide rollers 24 guided on the roller guide surfaces 11B and 12B in such a manner that the side guide rollers can roll idly. Moreover, the trolley main bodies 22 are each provided with a direction restricting roller (one example of a direction restricting member) 25 guided by the sideward guide sections 15*a*, 15*b*, 16*a*, 16*b*, 18*b*, and 19*b* of the guide members 15 to 17. The direction restricting roller 25 is constructed to be moved freely by lateral-movement means 30 in a lateral direction between a location corresponding to the linear-side guide member 15 or 16 and a location corresponding to the branching-and-joining-side guide member 17.

That is, the trolley main body 22 is provided with a lateral pair of brackets 26 in an upper part thereof, and a longitudinal pair of lateral guide rods 27 between the brackets 26. The trolley main body 22 has a support 28 supported and guided by the guide rods 27 so as to move freely in the lateral direction, and the direction restricting roller 25, provided on a top surface of the support 28 so as to roll freely and idly via a vertical pin 29.

The lateral-movement means 30 has a driving section (driving motor) 31 that can be driven forward and backward. The driving section 31 is provided in an upper part of the trolley main body 22 and has a driving shaft extending in the lateral direction. The trolley main body 22 is provided with a drive transmitting section 32 for moving the support 28 in the lateral direction in response to the frontward or backward driving effected by the driving section 31.

The drive transmitting section 32 comprises a cam roller 33 provided around a lateral axis so as to rotate freely, a spiral groove 34 formed in outer peripheral surface of the cam roller 33, a wind transmitting mechanism (timing belt or chain form) 35 that links a driving shaft of the driving section 31 with the cam roller 33, and others. In this case, the drive transmitting section 32 is provided with a clutch (an example of a connection and disconnection device) 36 for connecting and disconnecting a transmission path.

The spiral groove 34 has a cam follower 37 fitted therein and provided on the support 28. The support 28 is composed of a magnetic body in its entirety or only in its lateral ends. The brackets 26 are each provided with a magnetic member (one example of attracting means) 38 to attract and hold the support 28 in place, which has reached a corresponding lateral-movement limit location at the position where the support 28 provided at the both brackets 26 are contactable.

With the lateral-movement means 30 configured as described above, the cam roller 33 is rotated forward or backward via the wind transmitting mechanism 35 in response to the forward or backward driving effected by the driving section 31. Then, the support 28 is supported and guided by the guide rod 27 so as to move in the lateral direction via the cam follower 37, fitted in the rotating spiral groove 34, thereby moving the direction restricting roller 25 in the lateral direction via the support 28.

Thus, the direction restricting roller 25 is configured to freely move in the lateral direction between the location corresponding to the linear-side guide member 15 or 16 and the location corresponding to the branching-and-joining-side guide member 17. Then, the support 28, which has reached the corresponding lateral-movement limit location, is held at that position due to a attracting action effected by the magnet member 38. Further, the clutch 36 is disconnected to allow the cam roller 33 to rotate (roll) freely.

Power is supplied to the self-propelled member 20 using the non-contact feeding method. For this purpose, the rail members 11 (11*a*) and 12 (12*a*) have cord tracks 13 and 14 disposed in the direction of the rail length using the downward dove-tail groove portion 11D. A pickup coil 39 is provided between the trolley main bodies 22 of the self-propelled member 20. Further, the trolley main body 22 is provided with a detector 40, while the fixed path 50 is provided with a detection target (not shown) for travel control, at a predetermined location thereof.

The self-propelled member 20 has the holding device 41, provided between the trolley main bodies 22 in such a manner as to hang therefrom. The holding device 41 is shaped like a box that is open in right and left sides and in a bottom surface and that has a top surface connected to the trolley main bodies 22 via a connector 42. The holding device 41 has lateral-transfer means (not shown) or the like disposed therein. The trolley main bodies 22 are each provided with a stopper member 43 projected outward (forward and backward).

An operation of the above described first embodiment will be described below.

The self-propelled member 20 runs along the fixed path 50 so as to be guided as the group of wheels 21 roll while being supported and guided on the wheel supporting surfaces 11A and 12A, with the side guide rollers 24 guided on the roller guide surfaces 11B and 12B and guided to the rail devices 10, 10*a*. In this case, the self-propelled member 20 is fed with power via the pickup coil 39, located opposite the cord tracks 13 and 14, using the non-contact feeding method.

Figure 6A:
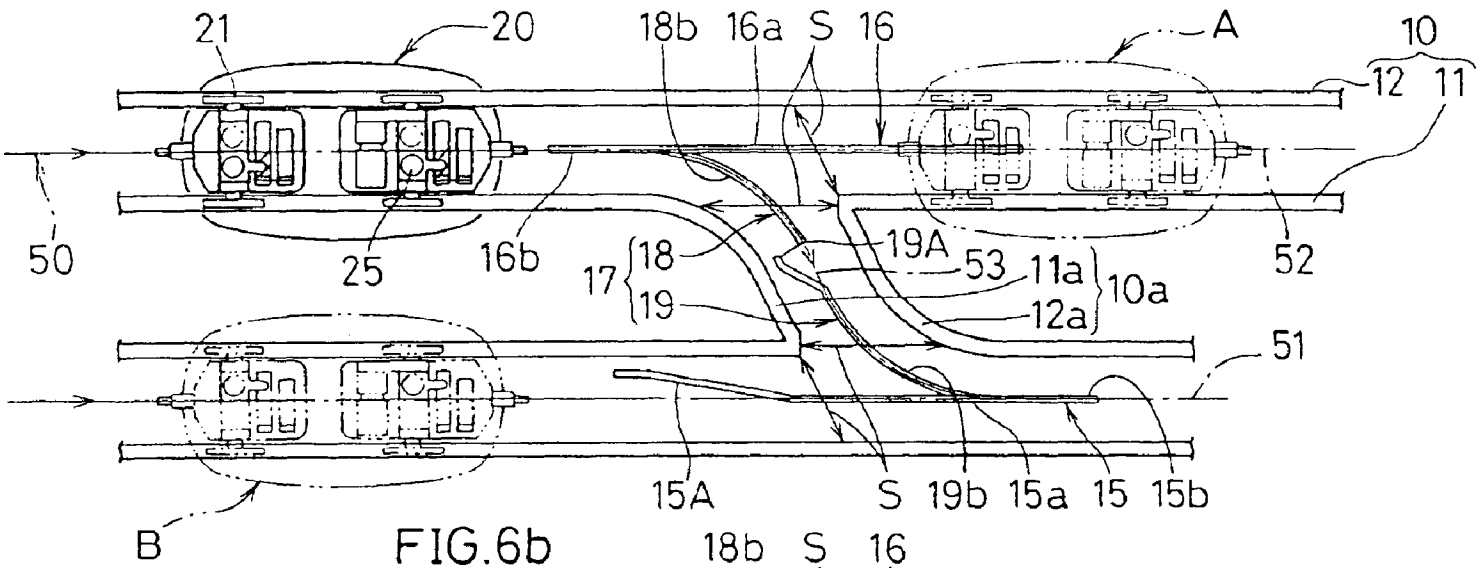
FIG. 6 is a top view of the branching-and-joining section of the conveyance system, FIG. 6*a* showing a state prior to branching and FIG. 6*b* showing a state during the branching.

In this state, while the self-propelled member 20 is running along the linear path portion 52 as shown by the solid line in FIG. 6A, the detector 40 detects the detection target a little before the self-propelled member 20 reaches the branching-and-joining section. The detector 40 then determines whether the self-propelled member should run straight in the same direction or branch to the other path, to move the direction restricting roller 25 in the direction in which the self-propelled member is to run (running direction).

That is, the driving section 31 is driven forward or backward in response to an instruction signal based on the determination. At this time, the clutch 36 is connected, so that the cam roller 33 is rotated forward or backward via the wind transmitting mechanism 35. Then, the support 38, while being supported and guided by the guide rods 27, is moved in the lateral direction via the cam follower 37, fitted in the rotating spiral groove 34. Consequently, the direction restricting roller 25 is moved in the lateral direction via the support 28.

Thus, the direction restricting roller 25 is moved in the lateral direction between the location corresponding to the linear-side guide member 16 and the location corresponding to the branching-and-joining-side guide member 17. The support 28 reaches the lateral-movement limit location and is held at that position due to the attracting action effected by the magnet member 38. Then, the clutch 36 is disconnected. If the direction restricting roller 25 has completed moving in the target direction when the instruction signal is given on the basis of the determination, this instruction signal is canceled to prevent the driving section 31 from being driven.

Figure 2:
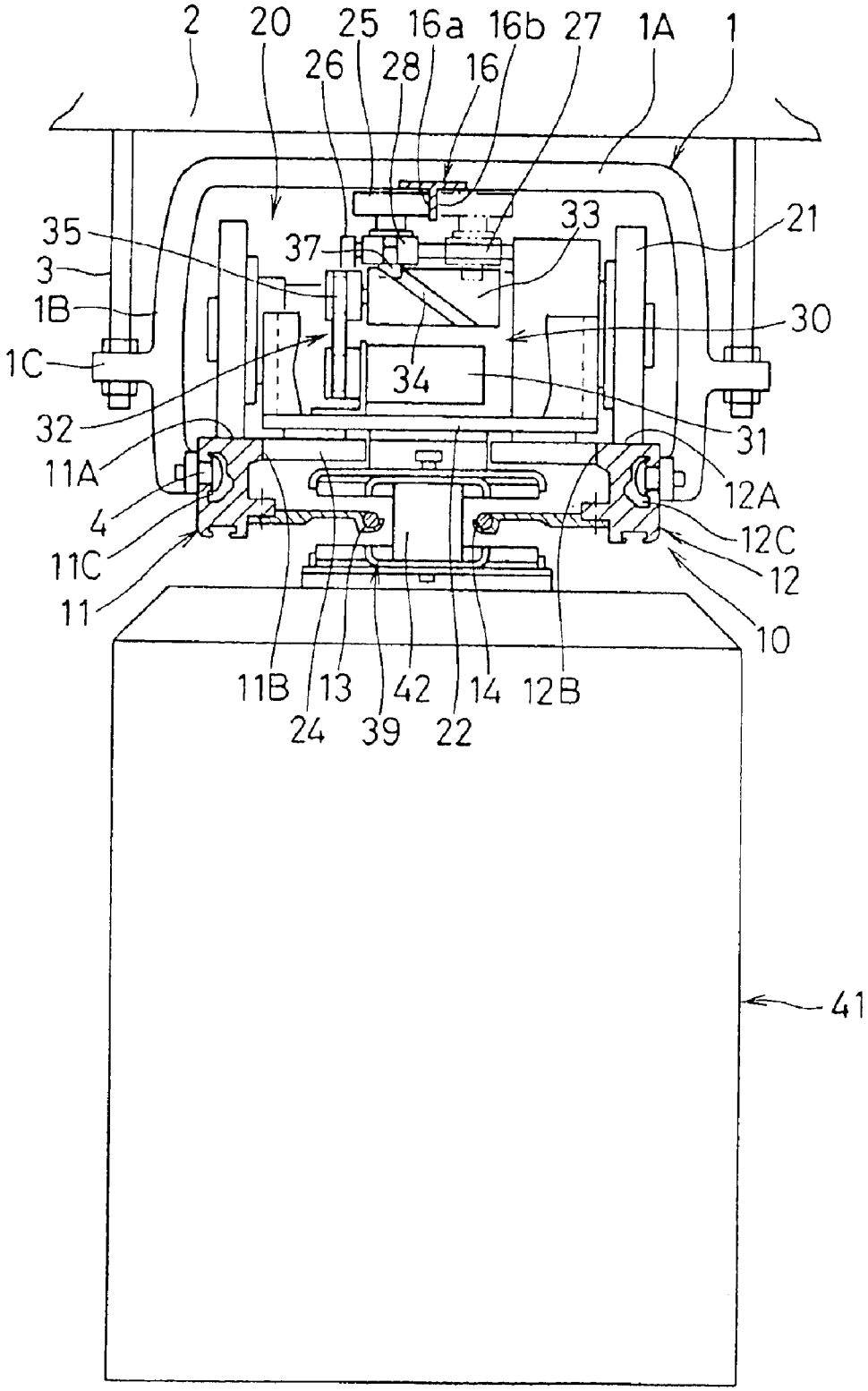
FIG. 2 is a partly cutaway front view of the conveyance system.
Figure 3:
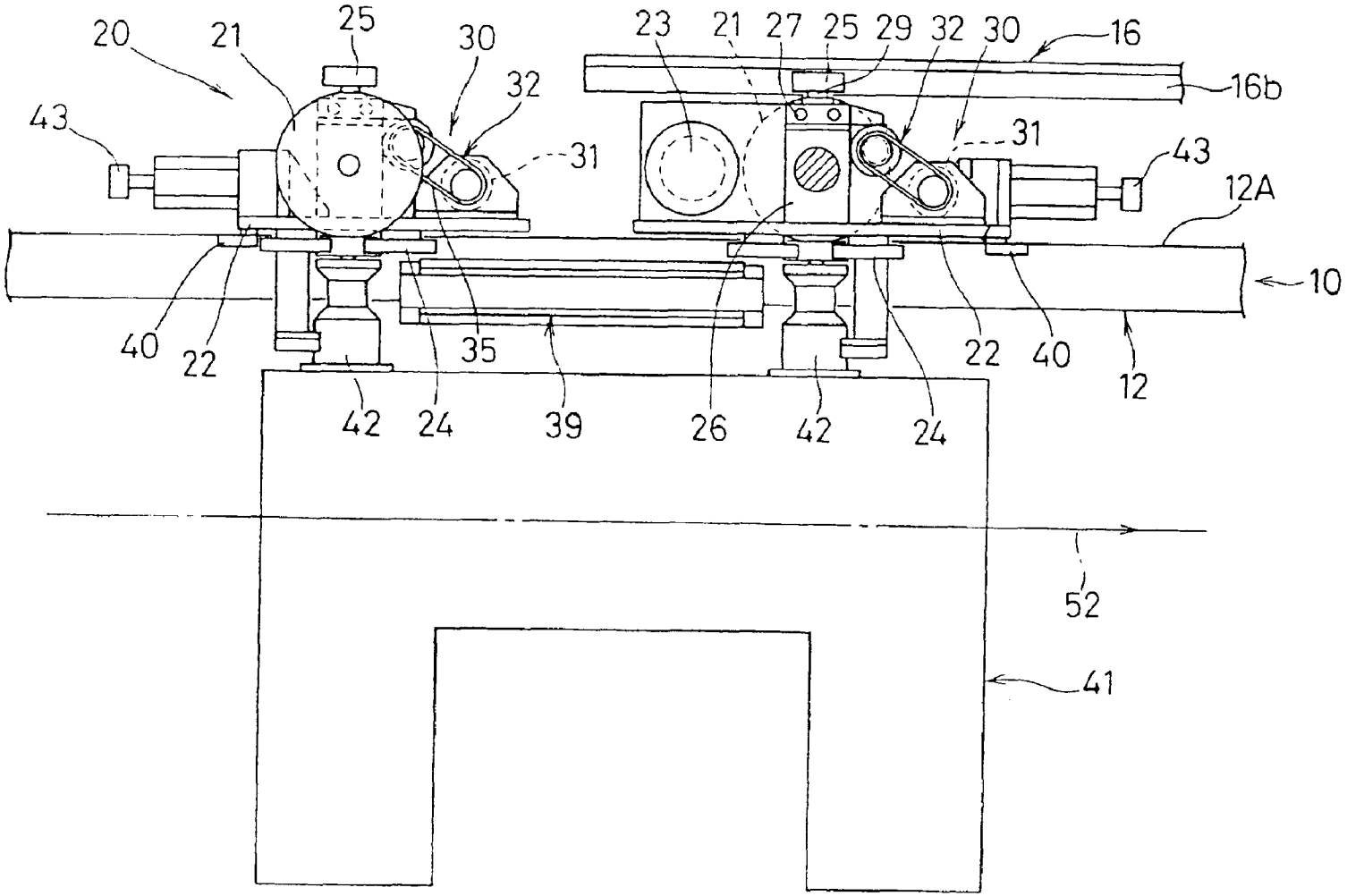
FIG. 3 is a partly cutaway side view of an essential part of the conveyance system.
Figure 4:
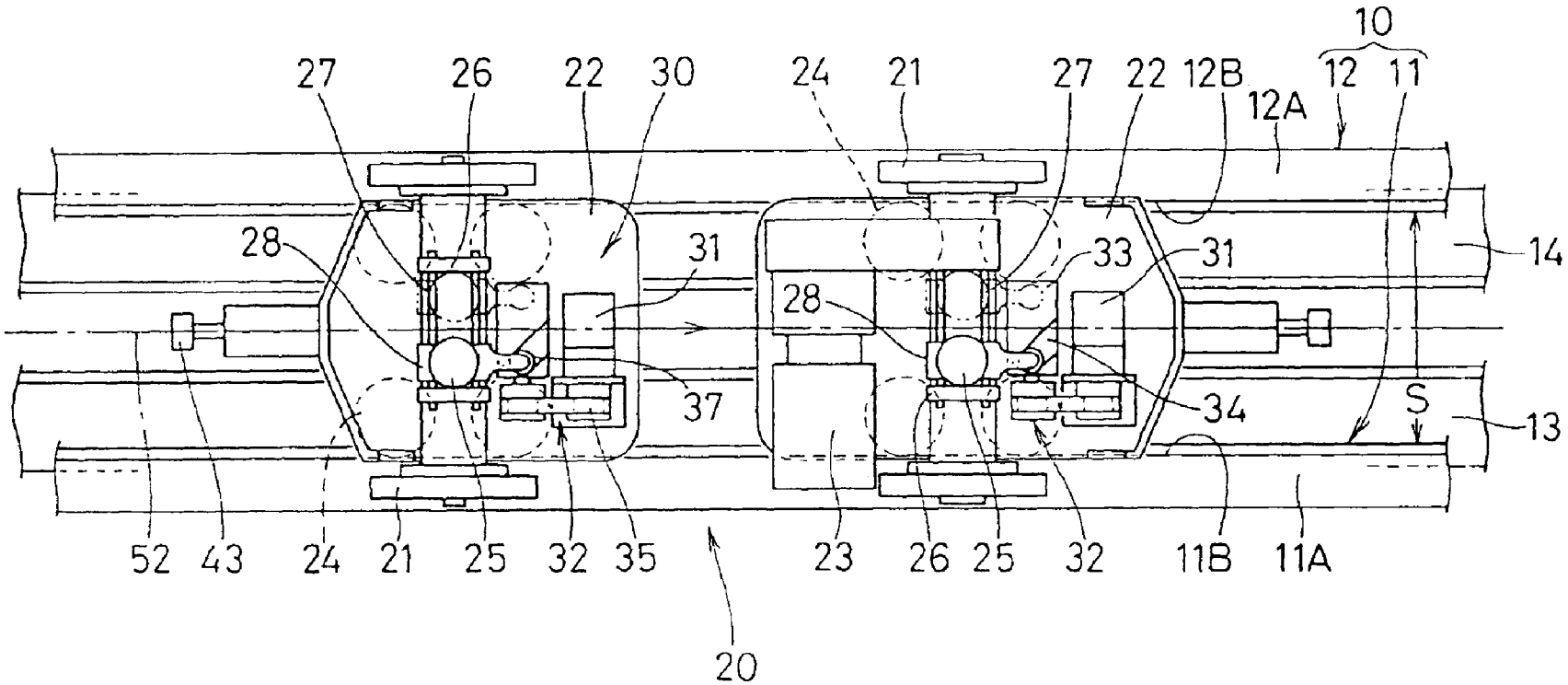
FIG. 4 is a top view of an essential part of the conveyance system.

For example, when the self-propelled member 20, running along the linear path portion 52, is determined to run straight in the same direction, the direction restricting member 25 is moved leftward as shown by the imaginary lines in FIGS. 2 and 4 and by the imaginary line in FIG. 6A. Then, the direction restricting roller 25 is guided by the linear-side guide section 16*a* of the linear-side guide member 16. Accordingly, the self-propelled member 20 runs straight in the same direction as shown by an imaginary line A in FIG. 6A.

Figure 5:
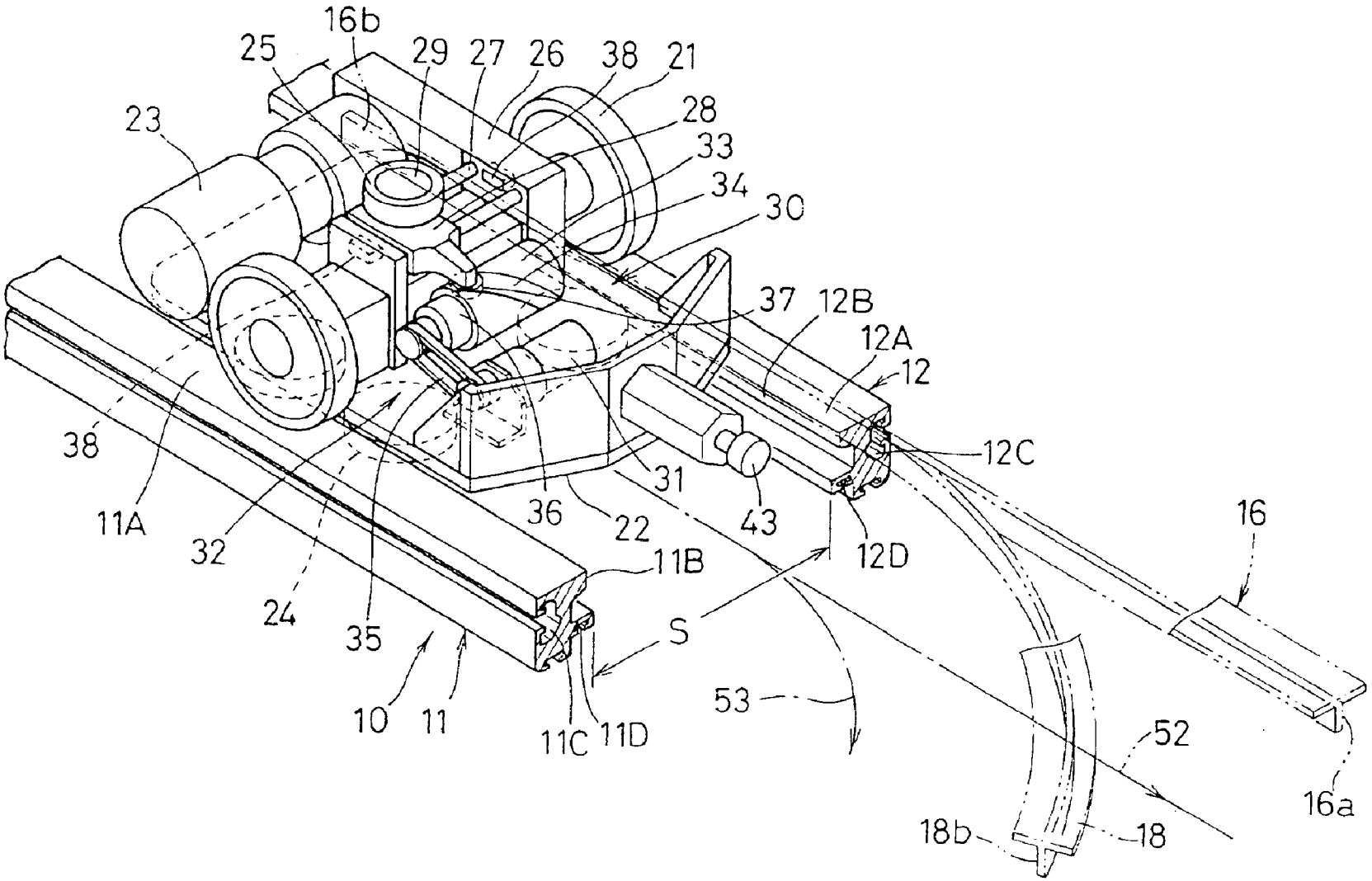
FIG. 5 is a perspective view of an essential part of a moving body in the conveyance system.
Figure 6B:
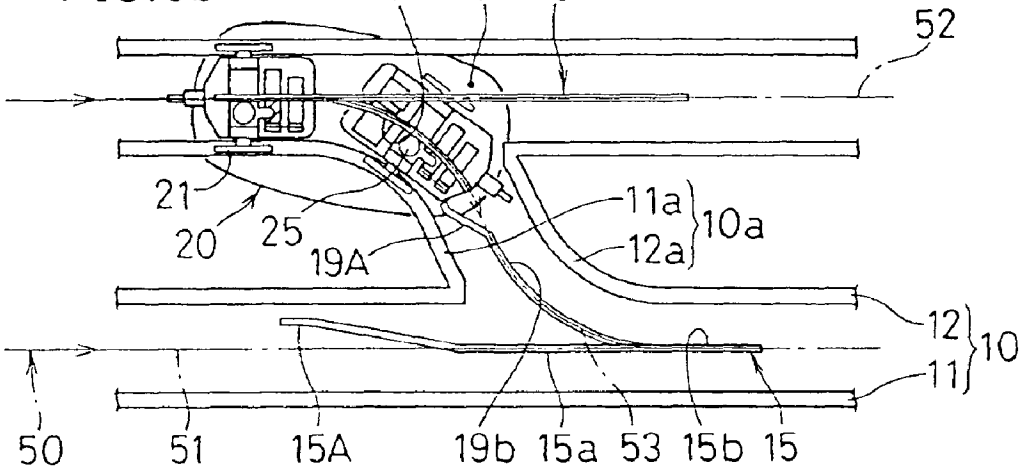

On the other hand, when the self-propelled member 20, running along the linear path portion 52, is determined to branch to the branching-and-joining path portion 53, the direction restricting roller 25 is moved rightward as shown by the solid lines in FIGS. 1, 2, and 4 and by the solid lines in FIGS. 5 and 6A. Then, the direction restricting roller 25 is guided from the branching-and-joining-side guide section 16*b* of the linear-side guide member 16 to the branching-side guide section 18*b* of the branching-side guide member 18 of the branching-and-joining-side guide member 17. Consequently, the self-propelled member 20 is branched to the branching-and-joining path portion 53 as shown in FIG. 6B.

Figure 7A:
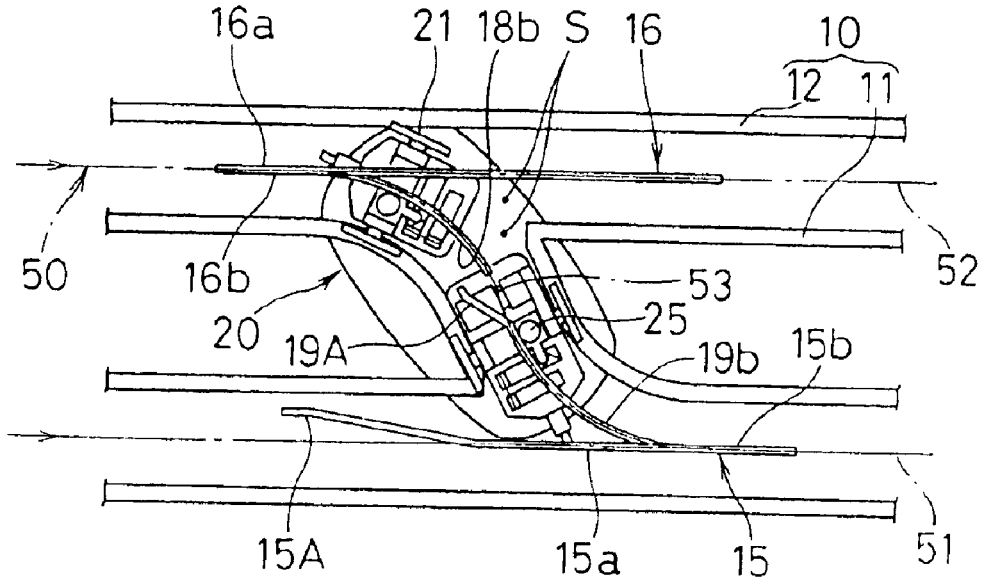
FIG. 7 is a top view of the branching-and-joining section of the conveyance system, FIG. 7*a* showing a state during branching and joining, and FIG. 7*b* showing a state during the joining.

Then, the direction restricting roller 25, guided by the branching-side guide section 18*b*, is engaged with the receiving section 19A of the joining-side guide member 19 of the branching-and-joining-side guide member 17. The direction restricting roller 25 is thus forcibly drawn in and guided to the joining-side guide section 19*b* of the joining-side guide member 19. Thus, the self-propelled member 20 runs along the branching-and-joining path portion 53 as shown in FIG. 7A.

When the direction restricting roller 25 is forcibly drawn in and guided from the receiving section 19A to the joining-side guide section 19*b* as described previously, it is moved leftward together with the support 28 and thus guided smoothly.

That is, the support 28 is held (locked) at the rightward-movement limit location due to the attracting action (magnetic force) effected by the magnetic body 38, but at this time, the clutch 36 has been disconnected to allow the cam roller 33 to roll freely. Accordingly, the draw-in force exerted when the direction restricting roller 25 is forcibly drawn in and guided by the joining-side guide section 19*b* clears the attraction effected by the magnet member 38, while causing the cam roller 33 to roll idly via the cam follower 37 and the spiral groove 34. Consequently, the direction restricting roller 25 is automatically moved leftward together with the support 28.

Figure 7B:
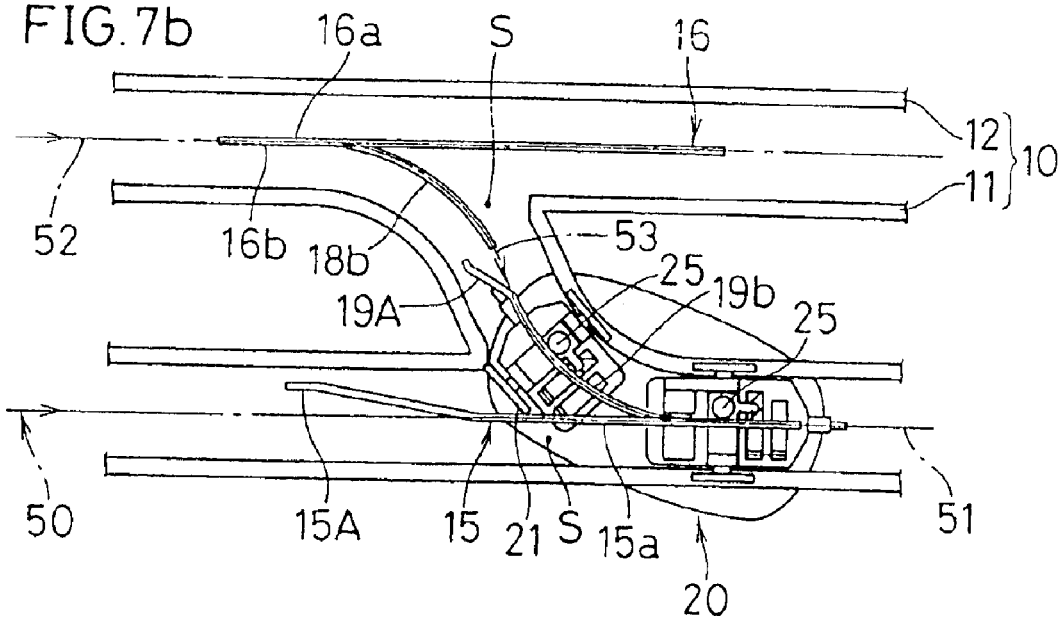

Then, the direction restricting roller 25, guided by the joining-side guide section 19*b*, is allowed to be guided to the branching-and-joining-side guide section 15*b* of the linear-side guide member 15. As a result, the self-propelled member 20 is joined to the linear path portion 51 as shown in FIG. 7B.

For example, as shown by an imaginary line B in FIG. 6A, the self-propelled member 20, running along the linear path portion 51, the joining side, and a self-propelled member 20 from the branching-and-joining path portion 53 are mutually controlled so that they will not collide against each other.

If the self-propelled member 20 runs straight along the linear path portion 51, when the direction restricting roller 25 is moved rightward before the branching-and-joining section, the self-propelled member 20 runs so as to follow the linear-side guide section 15*a* of the linear-side guide member 15. In this case, however, since the start end portion of the linear-side guide member 15 is formed into the receiving section 15A, the self-propelled member 20 is automatically moved rightward from the receiving section 15A to the linear-side guide section 15*a* without the need to move the direction restricting roller 25 rightward before the branching-and-joining section.

When the self-propelled member 20, running along the linear path portion 52, is branched to the branching-and-joining path portion 53, the left front wheel 21 of the self-propelled member 20 is first rolled so as to move across the space (missing part) S between the rail members 12 and 12*a*, as shown in FIG. 6B. Then, the left rear wheel 21 of the self-propelled member 20 is rolled so as to move across the space S between the rail members 12 and 12*a*, as shown in FIG. 7A. Consequently, the wheel 21 moving across the space S falls into this space S, and the weight of the self-propelled member 20 serves to generate a moment around the wheel 21 on the wheel supporting surface 11H, thus inclining the self-propelled member 20.

At this time, however, the direction restricting roller 25, lying at the rightward-movement limit location, corresponding to the wheel 21 located in the space S, is received and guided by the branching-side guide section 18*b*, facing opposite the space S, thereby enabling the moment on the self-propelled member 20 to be accommodated. Thus, the self-propelled member 20 is branched smoothly, while being hindered from inclining, thereby allowing the wheel 21 to move across the space S without falling into it.

On the other hand, when the self-propelled member 20, running along the branching-and-joining path portion 53, is joined to the linear path portion 51, the right front wheel 21 of the self-propelled member 20 is first rolled so as to move across the space S between the rail members 11*a* and 11. Then, the right rear wheel 21 of the self-propelled member 20 is rolled so as to move across the space S between the rail members 11*a* and 11, as shown in FIG. 7B.

At this time, the direction restricting roller 25, lying at the leftward-movement limit location, corresponding to the wheel 21 located in the space S, is received and guided by the joining-side guide section 19*b*, facing opposite the space S, thereby enabling the moment on the self-propelled member 20 to be accommodated. Thus, the self-propelled member 20 is joined smoothly, while being hindered from inclining, thereby allowing the wheel 21 to move across the space S without falling into it.

Furthermore, the self-propelled member 20 on the linear path portion 51, shown by the imaginary line B in FIG. 6A, runs straight in the branching-and-joining section, the left front wheel 21 of the self-propelled member 20 is rolled so as to move across the spaces between the rail members 12*a* and 12*a*. Then, the left rear wheel 21 of the self-propelled member 20 is rolled so as to move across the space S between the rail members 12*a* and 12*a*.

At this time, however, the direction restricting roller 25, lying at the rightward-movement limit location, corresponding to the wheel 21 located in the space S, is received and guided by the linear-side guide section 15*a*, facing opposite the space S, thereby enabling the moment on the self-propelled member 20 to be accommodated. Thus, the self-propelled member 20 runs straight smoothly, while being hindered from inclining, thereby allowing the wheel 21 to move across the space S without falling into it.

Figure 8:
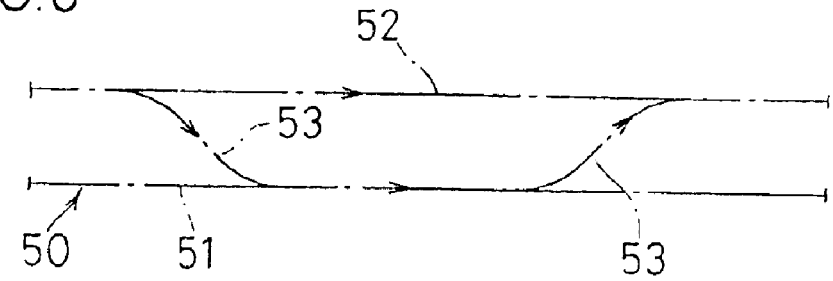
FIG. 8 is a schematic top view of the conveyance system.

In the first embodiment described above, the self-propelled member 20 on the linear path portion 52 is branched and joined to the linear path portion 51 via the branching-and-joining path portion 53. However, a layout is possible in which the self-propelled member 20 on the linear path portion 51 is branched and joined to the linear path portion 52 via the branching-and-joining path portion 53, as shown in FIG. 8.

Now, a second embodiment of the present invention will be described with reference to FIGS. 9 and 10. Here, FIGS. 9A to 9C and FIGS. 10A to 10F show variations (layouts) of this embodiment of the present invention.

Figure 9A:
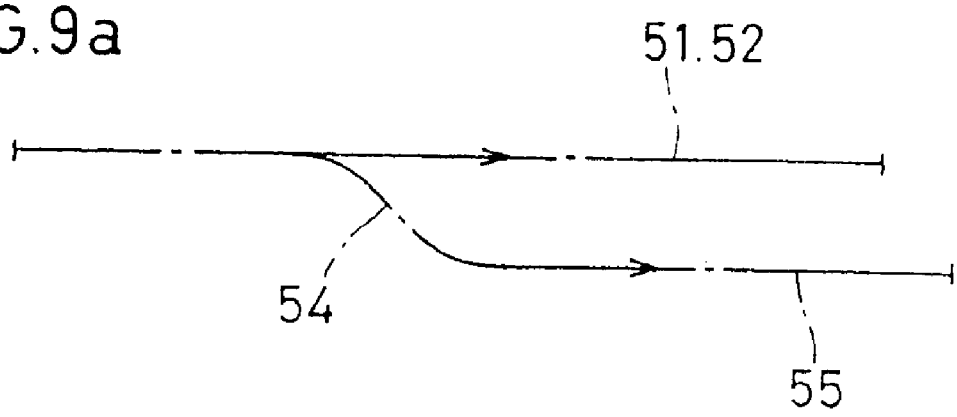
FIG. 9 is a schematic top view of a conveyance system according to a second embodiment of the present invention, FIGS. 9*a* to 9*c* being schematic top views showing variations of the embodiment.

FIG. 9A shows a form in which the self-propelled member 20 on the linear path portion 51 or 52 can be branched to another path portion 55 via a branching path portion 54.

Figure 9B:
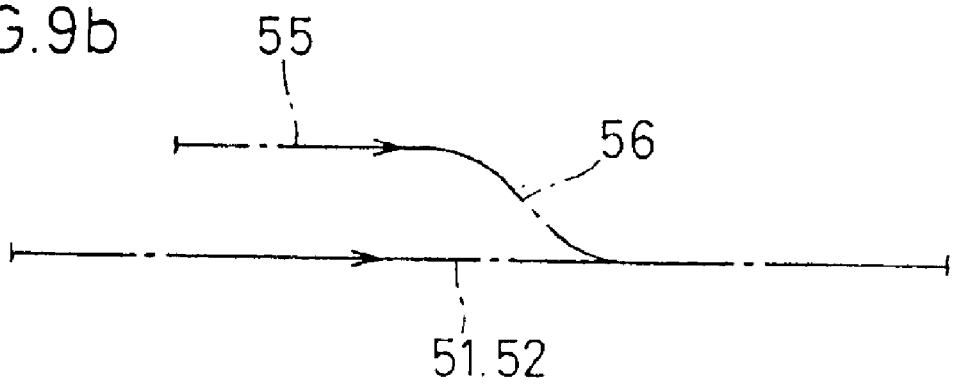

FIG. 9B shows a form in which the self-propelled member 20 on the another path portion 55 can be joined to the linear path portion 51 or 52 via a joining path portion 56.

Figure 9C:
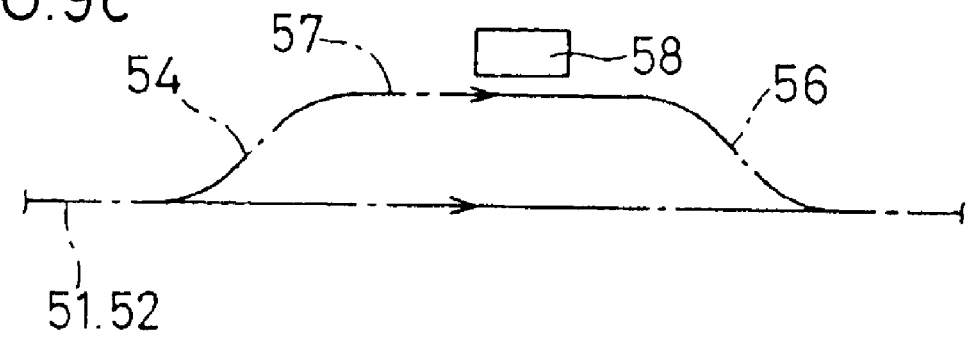

FIG. 9C shows a form in which the self-propelled member 20 on the linear path portion 51 or 52 can be branched to a station path portion 57 via the branching path portion 54, and the self-propelled member 20 on the station path portion 57 can further be joined to the linear path portion 51 or 52 via the joining path portion 56. The station path portion 57 is provided with a station 58 in and from which articles to be conveyed are loaded and unloaded.

Figure 10A:
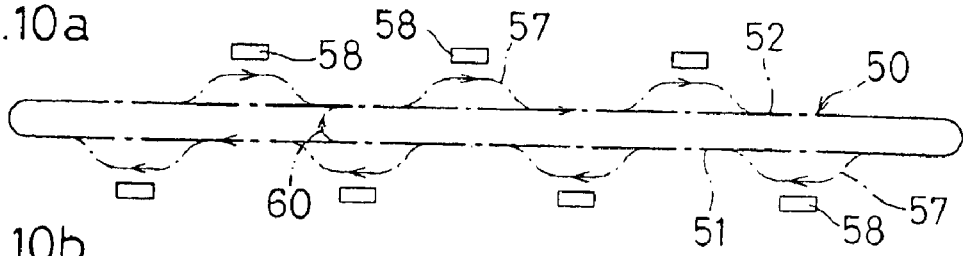
FIG. 10 is a schematic top view of a conveyance system according to a third embodiment of the present invention, FIGS. 10*a* to 10*f* being schematic top views showing variations of the embodiment.

FIG. 10A shows a form in which a plurality of station path portions 57 are branched and joined to each of the linear path portions 51 and 52 of the endless fixed path 50 shaped like an ellipse.

Figure 10B:
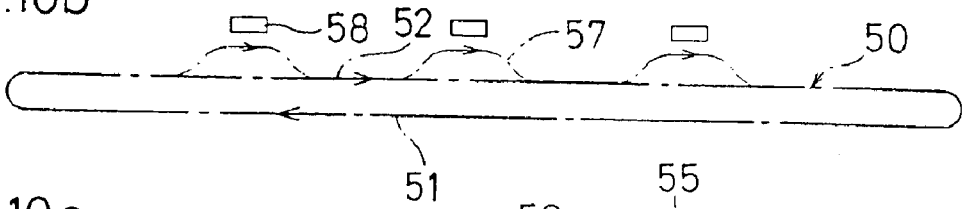

FIG. 10B shows a form in which a plurality of (or a single) station path portions 57 are branched and joined to only the linear path portion 52 of the endless fixed path 50 shaped like an ellipse.

Figure 10C:
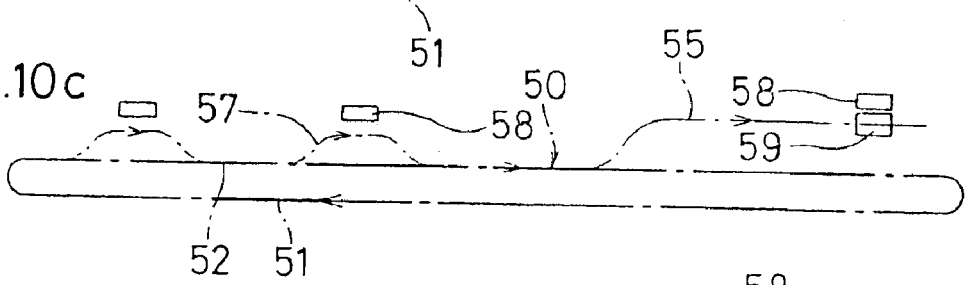

FIG. 10C shows a form in which an ended another path portion 55 is branched from one 52 (or both) of the linear path portions 51 and 52 of the endless fixed path 50 shaped like an ellipse. In this case, when the self-propelled member 20 reaches a terminal of the another path portion 55, it is moved to another floor (upper or lower floor) by elevating and lowering means (elevator) 59. The ended another path portions 55 may be provided at a plurality of locations.

Figure 10D:
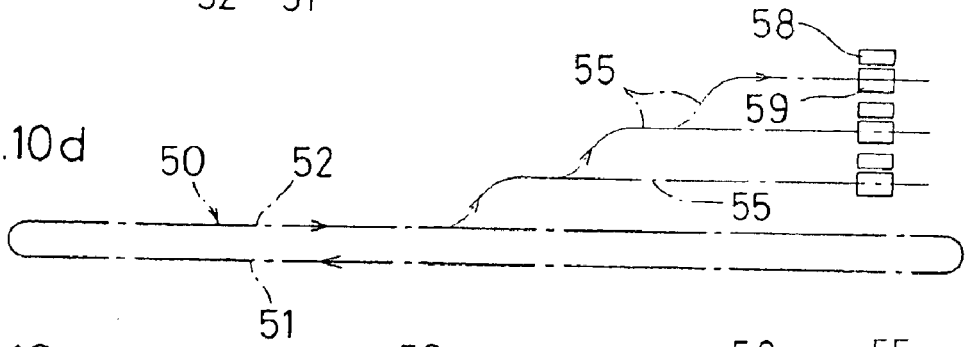

FIG. 10D shows a form in which an ended another path portion 55 is branched from one 52 (or both) of the linear path portions 51 and 52 of the endless fixed path 50 shaped like an ellipse, and one or more ended other path portions 55 are sequentially branched from the above another path portion 55. The ended another path portions 55 may be provided at a plurality of locations.

Figure 10E:
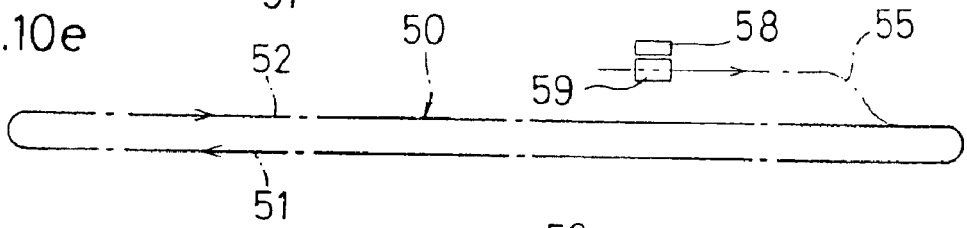

FIG. 10E shows a form in which an ended another path portion 55 is joined to one 52 (or both) of the linear path portions 51 and 52 of the endless fixed path 50 shaped like an ellipse. In this case, the self-propelled member 20 from another floor (upper or lower floor) is moved to a start end of the another path portion 55 by the elevating and lowering means (elevator) 59. The ended another path portion 55 may be provided at a plurality of locations.

Figure 10F:
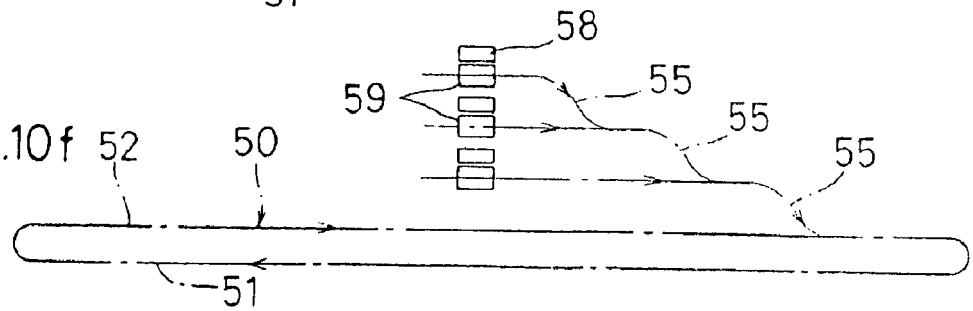
Figure 11:
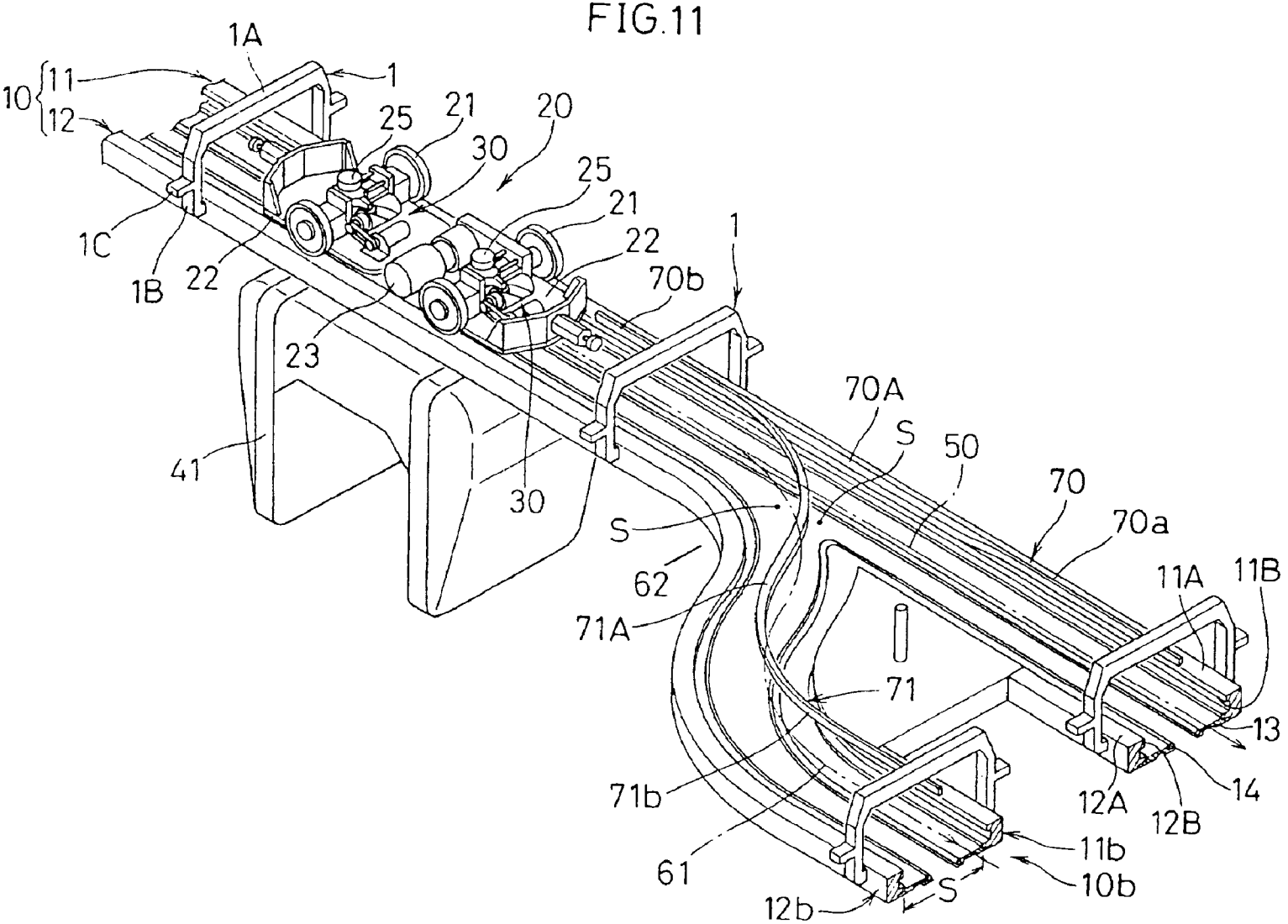
FIG. 11 is a perspective view of a branching portion of a conveyance system according to a fourth embodiment of the present invention.

FIG. 10F shows a form in which an ended another path portion 55 is joined to one 52 (or both) of the linear path portions 51 and 52 of the endless fixed path 50 shaped like an ellipse, and one or more ended other path portions 55 are sequentially joined to the above another path portion 55. The ended other path portions 55 may be provided at a plurality of locations.

FIGS. 10A to 10F, described above, show the layouts for one 52 (or both 51 and 52) of the linear path portions of the endless fixed path 50 shaped like an ellipse. However, similar layouts are applicable to the fixed path 50 composed of the pair of parallel lateral path portions 51 and 52 as shown in FIG. 8.

Further, as shown in FIG. 10A, a layout is possible in which one or more turn path portions 60 are branched and joined between the pair of linear path portions 51 and 52. With this layout, when the turn path 60 is used to turn the self-propelled member 20, a short-cut travel is achieved, thereby reducing the time required for operations.

Now, a third embodiment of the present invention will be described with reference to FIGS. 11 to 19.

In FIGS. 11 to 15, the rail apparatus 10, composed of the lateral pair of rail members 11 and 12, is essentially disposed like an endless ellipse to form the fixed path 50 shaped like an endless ellipse. A branching-and-joining path 61 is formed which is branched and joined to the fixed path 50. In a branching section 62 and a joining section 63 extending from and to the branching-and-joining path 61, one 12 of the lateral pair of rail members 11 and 12 which is located closer to the branching-and-joining path 61 is cut so as to form a space S, and rails 11*b* and 12*b* on the branching-and-joining path 61 are disposed so as to be contiguous to a cut end of the rail member.

That is, the lateral pair of rail members 11*b* and 12*b*, having the same sectional shape as the rail members 11 and 12, are also disposed on the branching-and-joining path 51 to constitute a rail apparatus 10*b*. The rail member 12*b*, extending from the section to form the fixed path 50 in the direction of the branching path, is bent outward in the branching-and-joining path 61 and then inward to form a straight line facing opposite a station 54, and is bent inward and then outward in the joining section 63 to form the fixed path 50.

Further, the other rail member 11*b* is formed to extend along the rail member 12*b* and has opposite ends connected to the cut ends of the rail body 12, forming the fixed path 50, extending in parallel with the linear portion of the branching-and-joining path 61. The rail members 11*b* and 12*b*, forming the branching-and-joining path 61, are cut at one or more locations thereof in linear portions thereof opposing the station 64, depending on the length of the branching-and-joining path 61. The cut portions of the rail members are connected together.

A fixed-path-side guide member 70 extending along the fixed path 50 and a branching-and-joining-side guide member 71 extending along the branching-and-joining path 61 are provided in the branching-and-joining sections 62 and 63. In this case, the guide members 70 and 71 are disposed between the lateral pair of rail members 11 and 12 and 11*b* and 12*b* and at upper locations, and are connected to the bottom surfaces of the top plate portions 1A of the rail yokes 1.

The fixed-path-side guide member 70 has a fixed-path-side guide section 70*a* located opposite the branching-and-joining path 61, and a branching-and-joining-side guide section 70*b* located closer to the branching-and-joining path 61. Further, the branching-and-joining-side guide member 71 has an outer surface forming a branching-and-joining guide section 71*b* leading to the branching-and-joining-side guide section 70*b*.

The trolley main bodies 22 of the self-propelled member 20 are each provided with the direction restricting roller (an example of a direction restricting member) 25, guided by the horizontal guide sections 70*a*, 70*b*, and 71*b* of the guide members 70 and 71. The direction restricting roller 25 is configured to be moved freely by the lateral-movement means 30 in the lateral direction between a location corresponding to the fixed-path-side guide member 70 and a location corresponding to the branching-and-joining-side guide member 71. The cam follower 37, provided on the support 28, is fitted in the spiral groove 34 in the lateral movement means 30.

With the lateral-movement means 30 configured as described above, the cam roller 33 is rotated forward or backward via the wind transmitting mechanism 35 in response to the forward or backward driving effected by the driving section 31. Then, the support 28 is supported and guided by the guide rod 27 so as to move in the lateral direction via the cam follower 37, fitted in the rotating spiral groove 34, thereby moving the direction restricting roller 25 in the lateral direction via the support 28. Thus, the direction restricting roller 25 is constructed to move freely in the lateral direction between the location corresponding to the fixed-path-side guide member 70 and the location corresponding to the branching-and-joining-side guide member 71.

In the branching section 62 or the joining section 63, when the direction restricting roller 25 is guided by the guide members 70 and 71, the wheel 21 in the space S floats from the wheel supporting surface 11A or 12A.

That is, the wheel 21 on the fixed path 50 (opposite side to the space S) is supported on the wheel supporting surface 11A, while the direction restricting roller 25 is guided by the fixed-path-side guide section 70*a* of the fixed-path-side guide member 70, so that the self-propelled member 20 is inclined relative to the lateral direction to cause the wheel 21 on the branching-and-joining path 61 (in the space S) to float from the wheel supporting surface 12A.

For this purpose, for example, at least a portion of the fixed-path-side guide member 70, that is, a portion corresponding to the branching section 62 or the joining section 63 is formed as a thickened portion 70A so that the direction restricting roller 25 is guided (received) by the thickened portion 70A. Accordingly, a side of the self-propelled member 20 which is located on the branching-and-joining path 61 is lifted, so that the self-propelled member 20 is inclined relative to the lateral direction.

On the other hand, the wheel 21 on the branching-and-joining path 61 (opposite side to the space S) is supported on the wheel supporting surface 12A, while the direction restricting roller 25 is guided by the branching-and-joining-side guide section 71*b* of the branching-and-joining-side guide member 71, so that the self-propelled member 20 is inclined relative to the lateral direction to cause the wheel 21 on fixed path 50 (at the space S side) to float from the wheel supporting surface 11A.

For this purpose, for example, at least a portion of the branching-and-joining-side guide member 71, that is, a portion corresponding to the branching section 62 or the joining section 63 is formed as a thickened portion 71A so that the direction restricting roller 25 is guided (received) by the thickened portion 71A. Accordingly, a side of the self-propelled member 20 which is located on the fixed path 50 is lifted, so that the self-propelled member 20 is inclined relative to the lateral direction. In this case, in fact, the branching-and-joining-side guide member 71 is thin in an entry portion, becomes thicker in the branching-and-joining sections 62 and 63, and then becomes thinner again in a terminal portion.

An operation of the third embodiment described above will be described below.

The self-propelled member 20 runs along the fixed path 50 or the branching-and-joining path 61 when guided by the rail apparatus 10 or 10*b* by supporting and guiding the group of wheels 21 on the wheel supporting surfaces 11A and 12A so as to roll thereon and guiding the side guide rollers 24 on the roller guide surfaces 11B and 12B. In this case, the self-propelled member 20 is fed with power via the pickup coil 39, located opposite the cord tracks 13 and 14, using the non-contact feeding method.

Figure 18A:
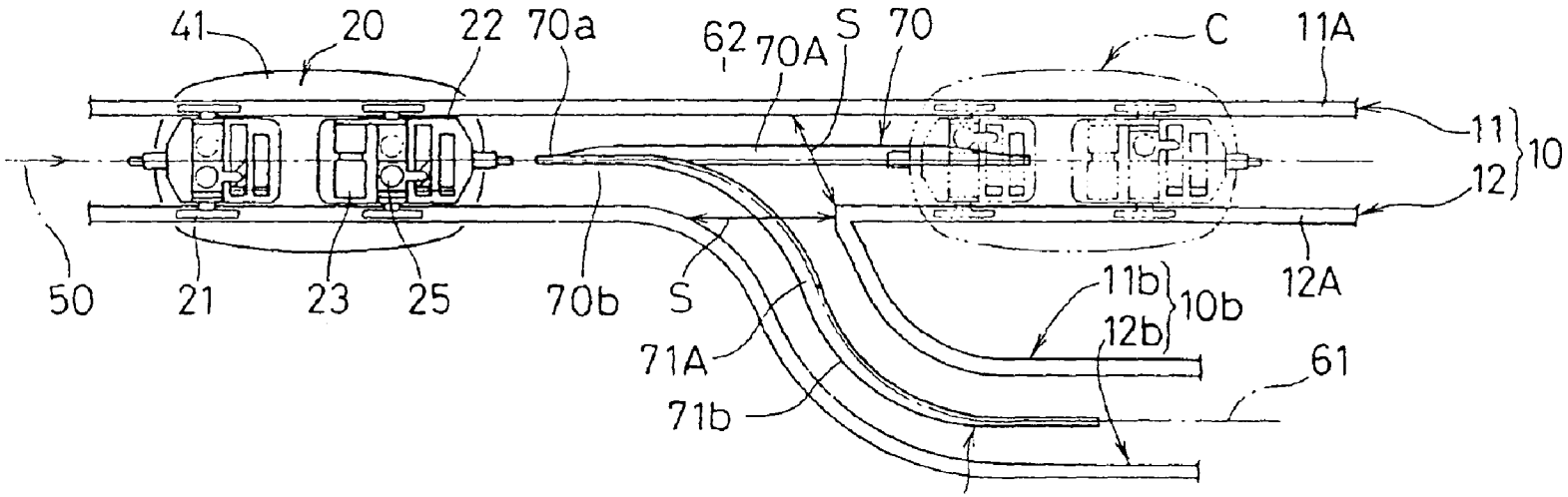
FIG. 18 is a top view of a branching-and-joining section of the conveyance system, FIG. 18*a* showing the branching portion and FIG. 18*b* showing a joining section.

In this state, while the self-propelled member 20 is running along the fixed path 50 as shown by the solid line in FIG. 18A, the detector 40 detects the detection target a little before the self-propelled member 20 reaches the branching section 62. The detector 40 then determines whether the self-propelled member should run straight in the same direction or branch to the other path, to move the direction restricting roller 25 in the direction in which the self-propelled member is to run (running direction).

That is, the driving section 31 is driven forward or backward in response to an instruction signal based on the determination, and the cam roller 33 is rotated forward or backward via the wind transmitting mechanism 35. Then, the support 28 is supported and guided by the guide rod 27 so as to move in the lateral direction via the cam follower 37, fitted in the rotating spiral groove 34, thereby moving the direction restricting roller 25 in the lateral direction via the support 28.

Thus, the direction restricting roller 25 is moved freely in the lateral direction between the location corresponding to the fixed-path-side guide member 70 and the location corresponding to the branching-and-joining-side guide member 71. If the direction restricting roller 25 has completed moving in the target direction when the instruction signal is given on the basis of the determination, this instruction signal is canceled to prevent the driving section 31 from being driven.

Figure 15:
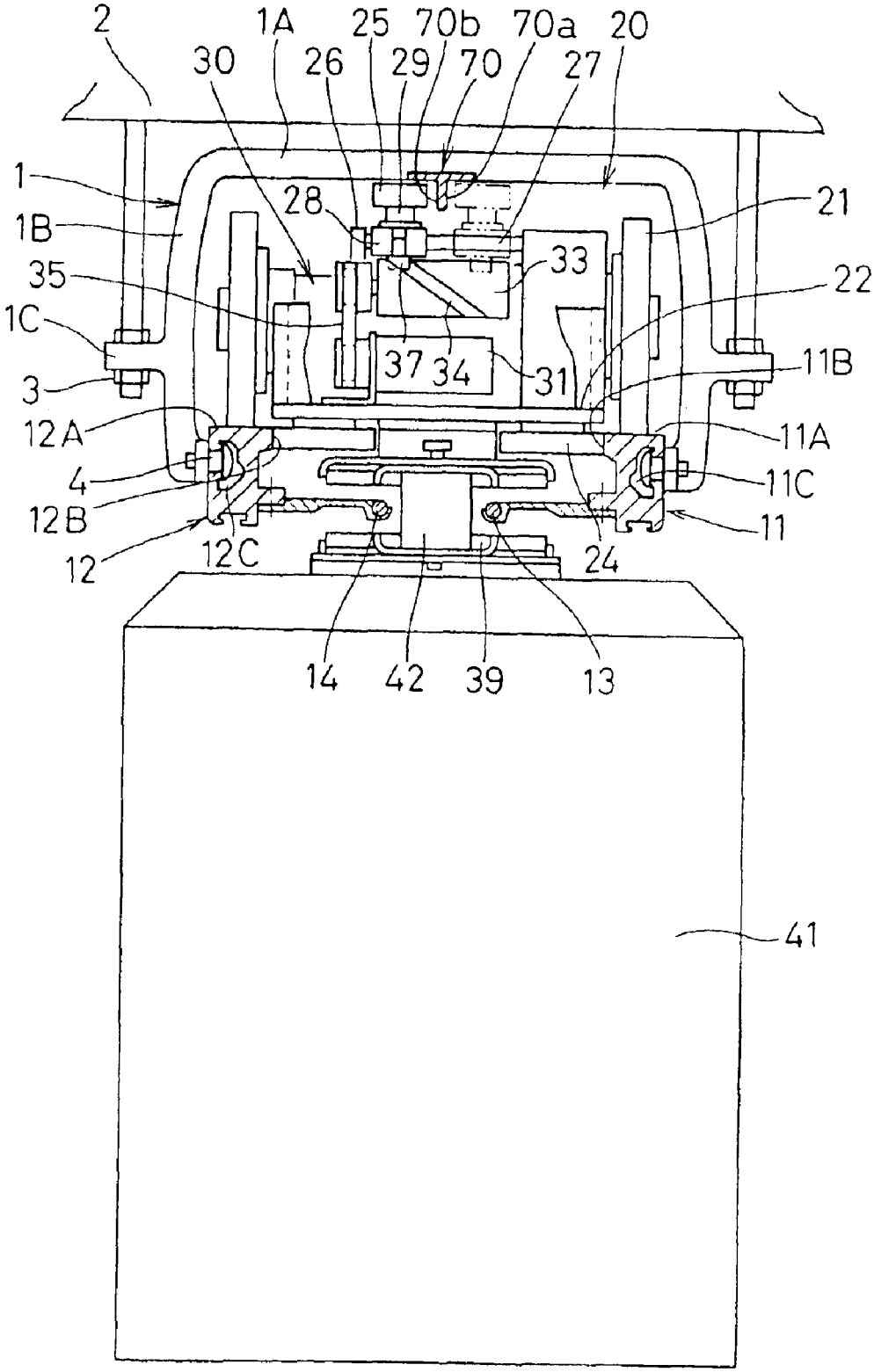
FIG. 15 is a vertically sectional front view of the conveyance system.

For example, when the self-propelled member 20, running along the linear path portion 50, is determined to run straight in the same direction, the direction restricting member 25 is moved leftward as shown by the imaginary lines in FIGS. 15 and 18A. Then, the direction restricting roller 25 is guided by the fixed-path-side guide section 70*a* of the fixed-path-side guide member 70. Consequently, as shown by an imaginary line C in FIG. 18A, the self-propelled member 20 is passed beside the branching-and-joining path 61 to run straight in the same direction without moving into the branching-and-joining path 61.

Figure 14:
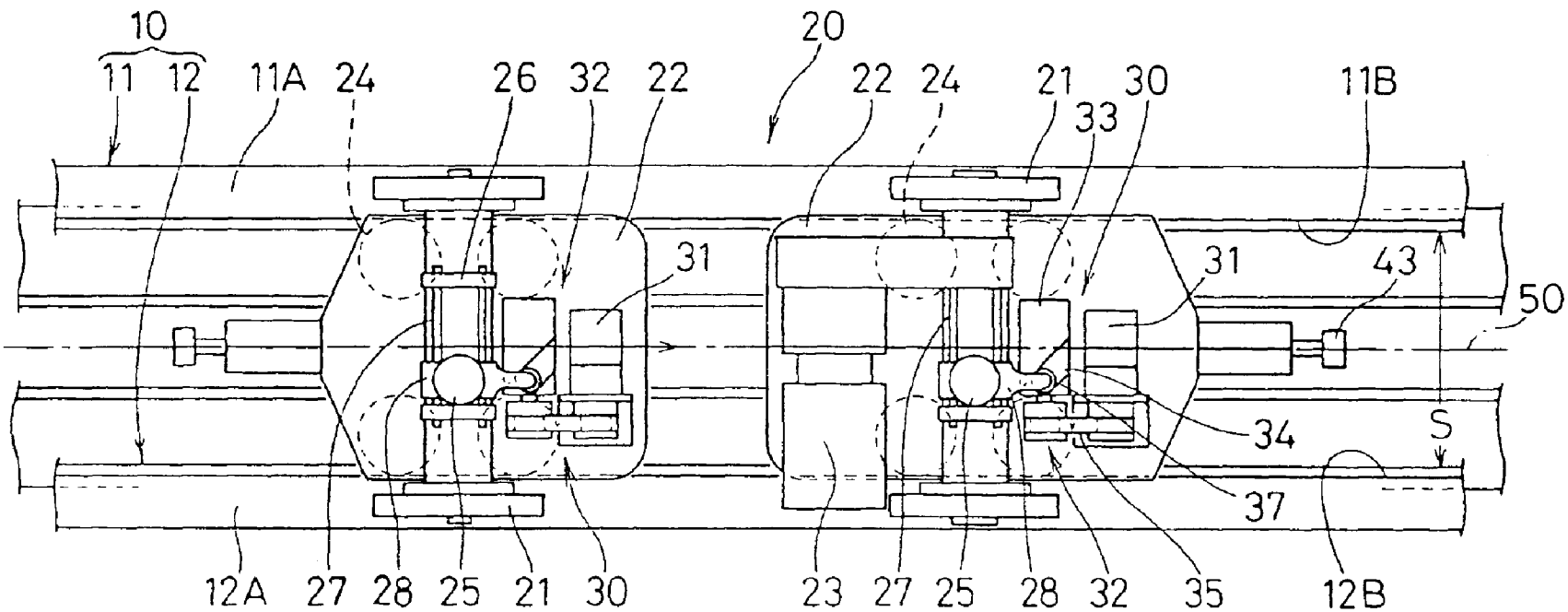
FIG. 14 is a partly cutaway top view of an essential part of the conveyance system.
Figure 17:
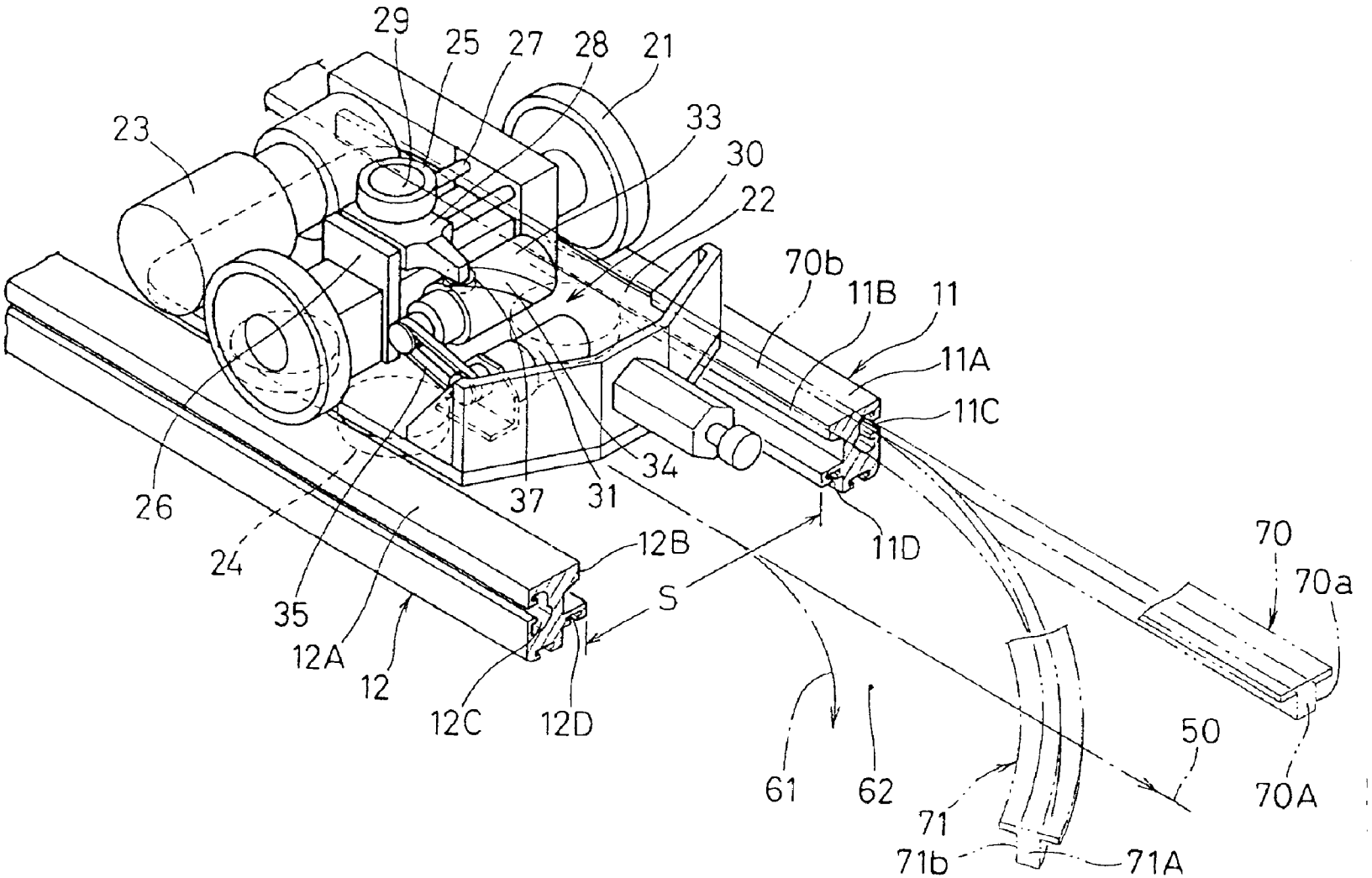
FIG. 17 is a perspective view of an essential part of a moving body in the conveyance system.

On the other hand, when the self-propelled member 20, running along the fixed path 50, is determined to branch to the branching-and-joining path 61 in order to stop at the destined station 64, the direction restricting roller 25 is moved rightward as shown by the solid lines in FIGS. 14 and 15 and by the solid lines in FIGS. 17 and 18A. Then, the direction restricting roller 25 is guided from the branching-and-joining-side guide section 70*b* of the fixed-path-side guide member 70 to the branching-and-joining-side guide section 71*b* of the branching-and-joining-side guide member 71. Consequently, the self-propelled member 20 is branched to the branching-and-joining path 61 as shown by an imaginary line D in FIG. 18B.

In this manner, the self-propelled member 20, running on the fixed path 50, can be branched to the branching-and-joining path 61 and stopped at the destined station 64. Thus, the transfer means of the holding device 41 can be used to load articles on the station 64. During such an operation, another self-propelled member 20 can run on the fixed path 50 irrespective of the operation on the branching-and-joining path 61.

After completing the intended operation at the station 64, the self-propelled member 20 in the joining section 63 can be joined to the fixed path 50. That is, the direction restricting roller 25 is guided from the branching-and-joining-side guide section 71*b* of the branching-and-joining-side guide member 71 to the branching-and-joining-side guide section 70*b* of the fixed-path-side guide member 70. Consequently, the self-propelled member 20 is joined to the fixed path 50. At this time, the self-propelled member 20, running along the fixed path 50, and a self-propelled member 20 from the branching-and-joining path 61 are mutually controlled so that they will not collide against each other.

Figure 19A:
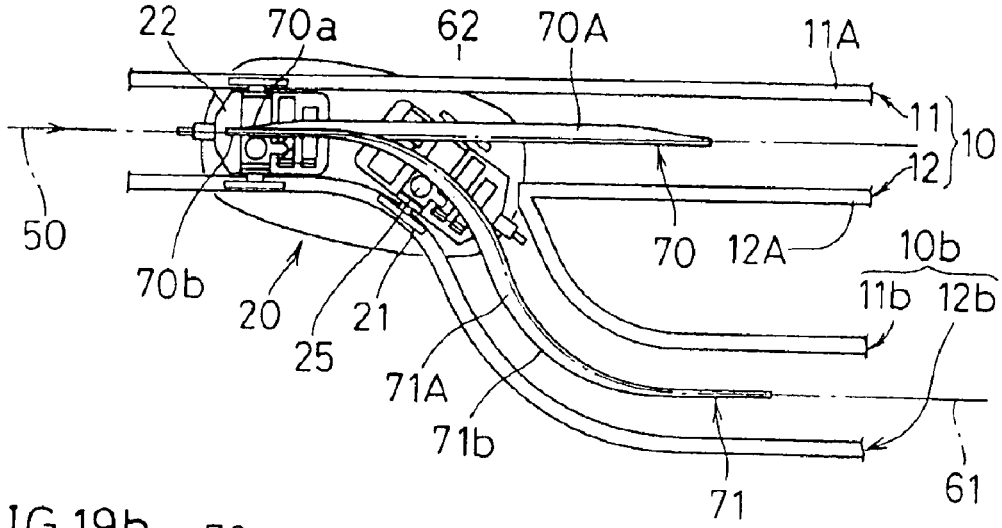
FIG. 19 is a top view of the branching-and-joining section of the conveyance system, FIG. 19*a* being a state at the start of branching, FIG. 19*b* showing a state during the branching and FIG. 19*c* showing a state at the end of the branching.
Figure 19B:
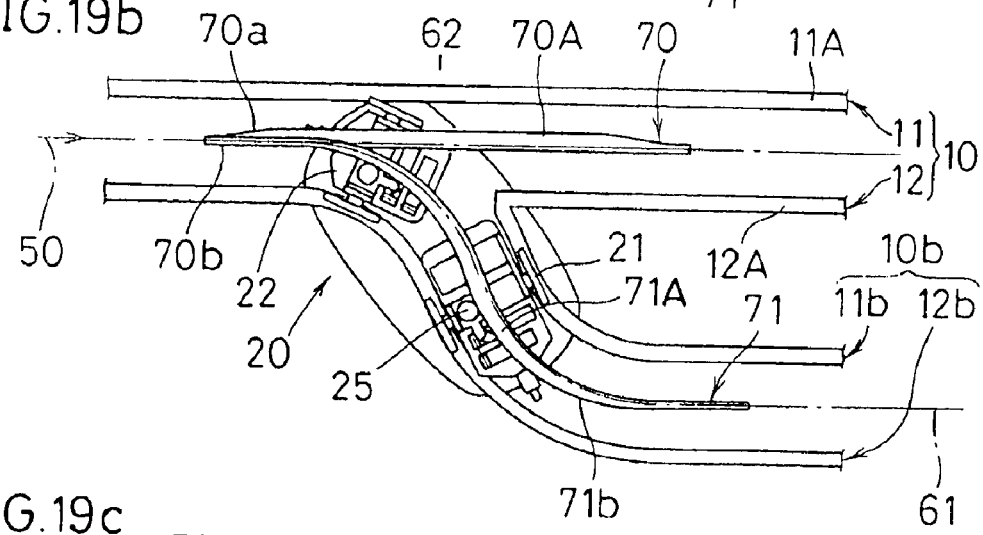
Figure 19C:
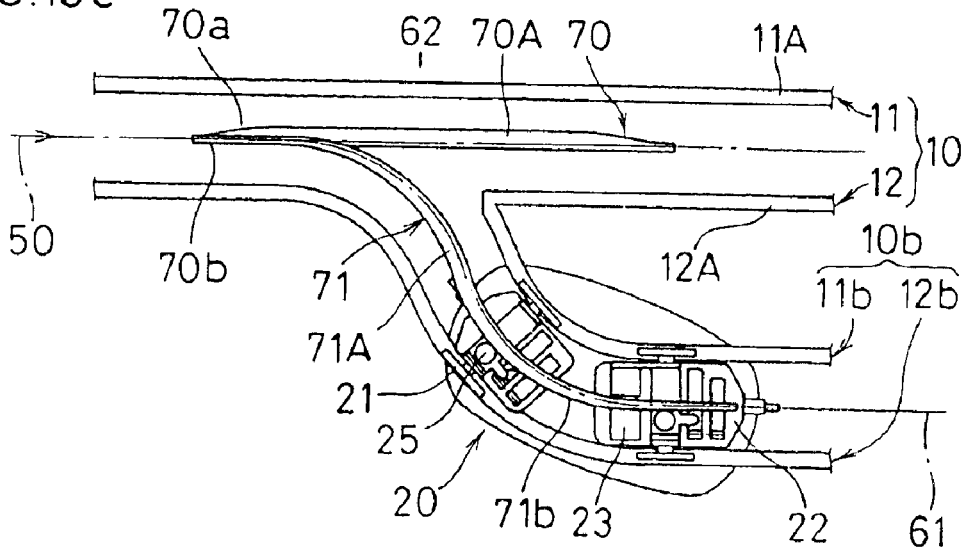

As described above, when the self-propelled member 20, running along the fixed path 50, is branched to the branching-and-joining path 61, the left front wheel 21 of the self-propelled member 20 is first rolled so as to move across the space (missing part) S between the rail members 11 and 11*b*, as shown in FIG. 19A. Then, the left rear wheel 21 of the self-propelled member 20 is rolled so as to move across the space S between the rail members 11 and 11*b*, as shown in FIG. 19B.

Figure 18B:
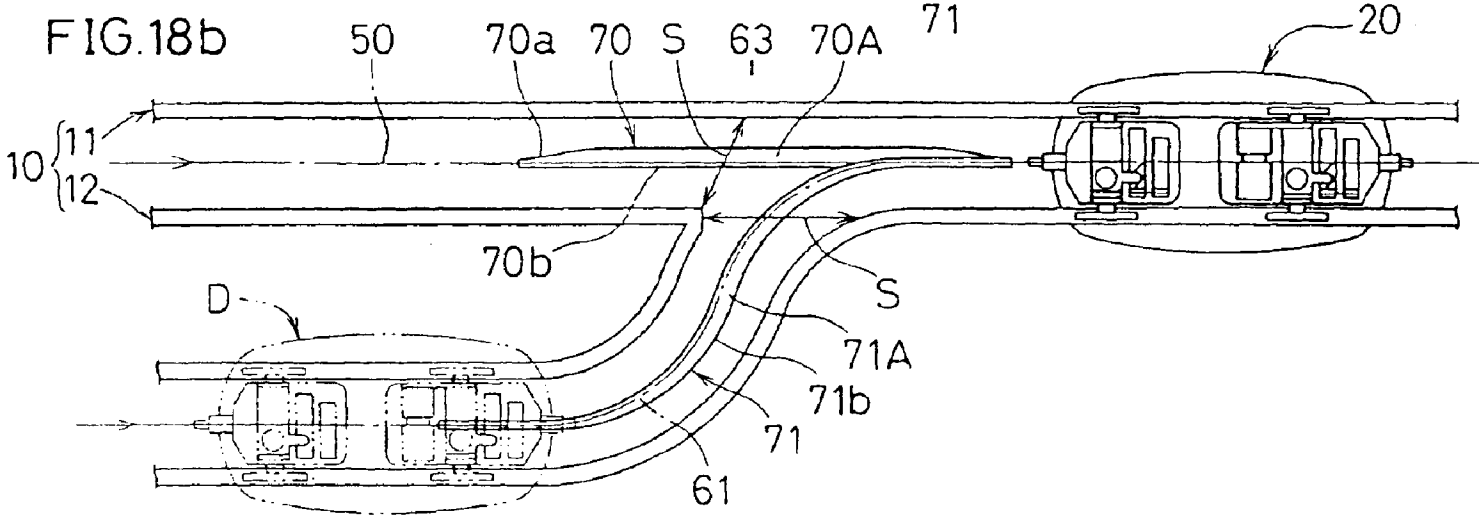

On the other hand, as shown by the imaginary line D in FIG. 18B, when the self-propelled member 20, running along the branching-and-joining path 61, is joined to the fixed path 50, the left front wheel 21 of the self-propelled member 20 is first rolled so as to move across the space S between the rail members 11 and 11*b*, and then the left rear wheel 21 of the self-propelled member 20 is rolled so as to move across the space S between the rail members 11 and 11*b*.

At this time, the wheel 21 moving across the space S falls into this space S (slips out from the rail member), and the weight of the self-propelled member 20 serves to generate a downward moment around the wheel 21 on the wheel supporting surface 12A, thus inclining the self-propelled member 20 leftward and downward.

Figure 16A:
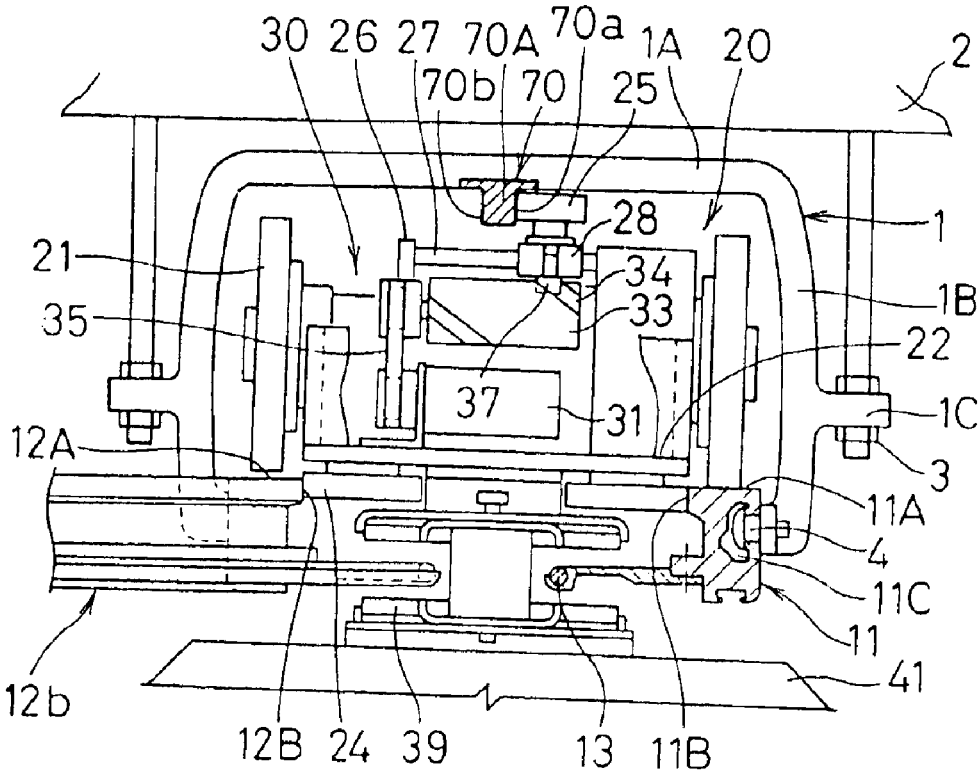
FIG. 16 is a vertically sectional front view of the branching portion of the conveyance system, FIG. 16*a* showing a state during a linear travel and FIG. 16*b* showing a state during a branching travel.
Figure 16B:
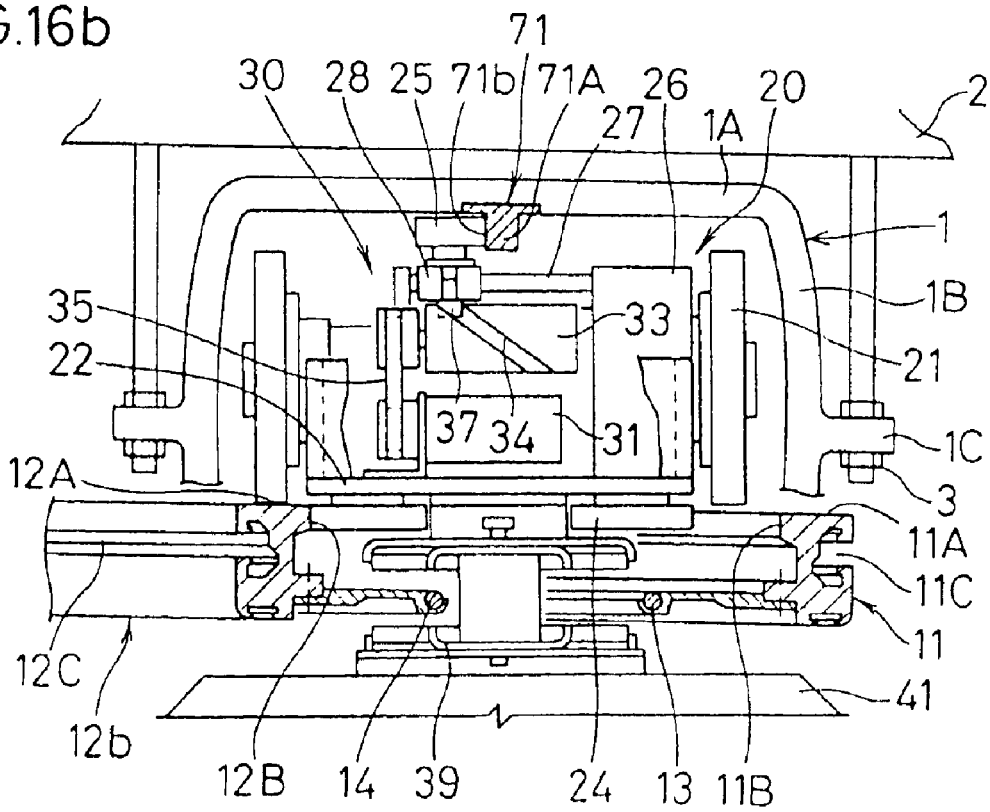

At this time, however, as shown in FIG. 16B, the direction restricting roller 25, lying at the rightward-movement limit location, corresponding to the wheel 21 located in the space S, is guided to the thickened portion 71A of the branching-and-joining-side guide member 71. Accordingly, a side of the self-propelled member 20 which is located on the fixed path 50 (left side) is lifted, and the self-propelled member 20 is inclined so that its left side is located higher than its right side. That is, the wheel 21 on the fixed path 50 floats from the wheel supporting surface 12A, thereby enabling the downward moment on the self-propelled member 20 to be accommodated. Thus, the self-propelled member 20 is branched smoothly, while being hindered from inclining so that its left side is located lower, thereby allowing the wheel 21 to move across the space S without falling thereinto.

Furthermore, when the self-propelled member 20 on the fixed path 50 runs straight in the branching-and-joining sections 62 and 63 without moving into the branching-and-joining path 61 as shown by the imaginary line C in FIG. 18A, the right front wheel 21 of the self-propelled member 20 is rolled so as to move across the spaces S between the rail members 12 and 11*b* and between the rail members 11*b* and 12. Then, the right rear wheel 21 is rolled so as to move across the spaces S between the rail members 12 and 11*b* and between the rail members 11*b* and 12.

At this time, however, as shown in FIG. 16A, the direction restricting roller 25, lying at the leftward-movement limit location, corresponding to the wheel 21 located in the space S, is guided to the thickened portion 70A of the fixed-path-side guide member 70. Accordingly, a right side of the self-propelled member 20 is lifted, and the self-propelled member 20 is inclined so that its right side is located higher than its left side. That is, the wheel 21 on branching-and-joining path 61 (right side) floats from the wheel supporting surface 12A, thereby enabling the downward moment on the self-propelled member 20 to be accommodated. Thus, the self-propelled member 20 is branched smoothly, while being hindered from inclining so that its right side is located lower, thereby allowing the wheel 21 to move across the space S without falling thereinto.

Figure 12:
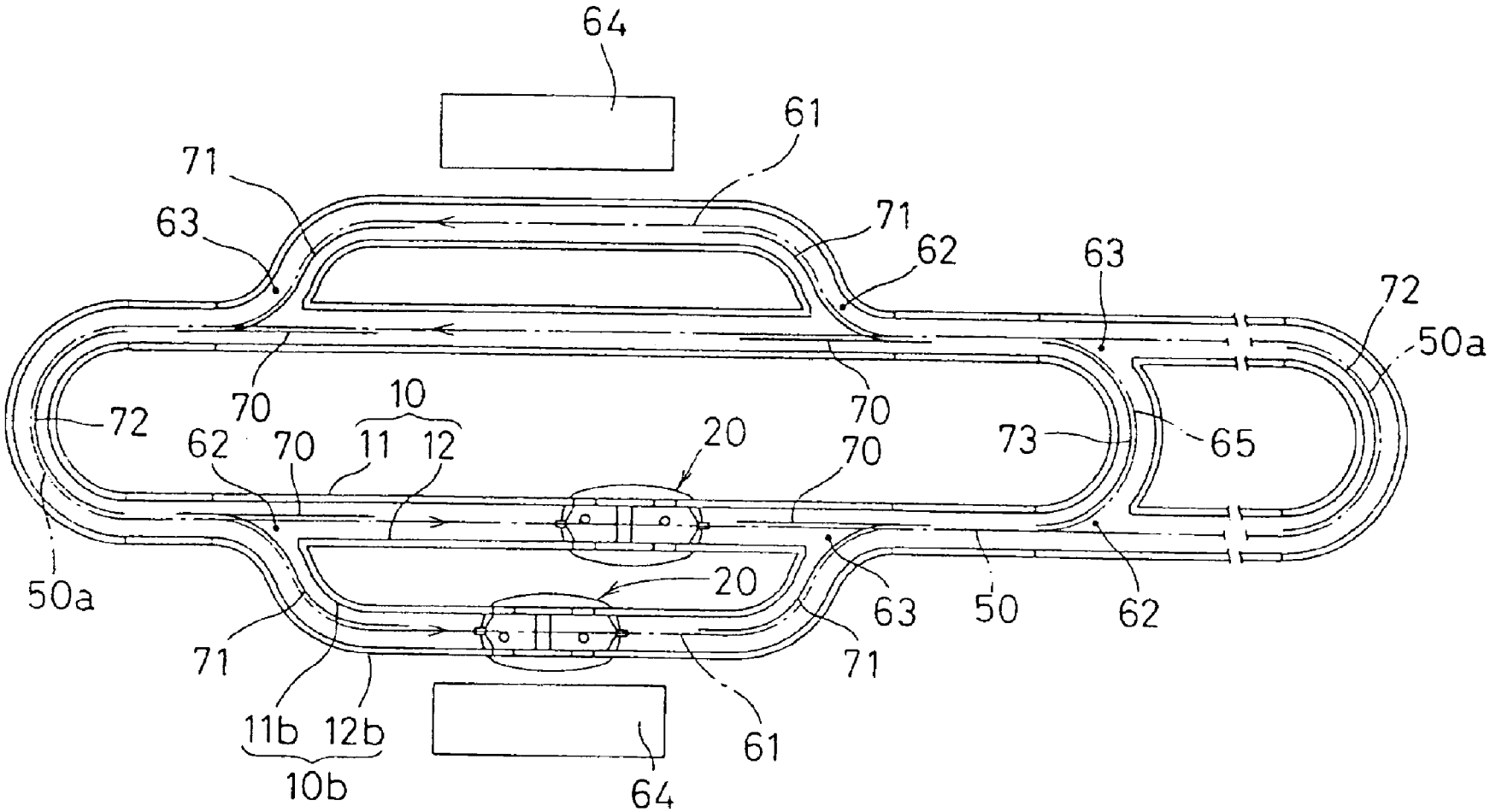
FIG. 12 is a partly cutaway top view of the conveyance system.
Figure 13:
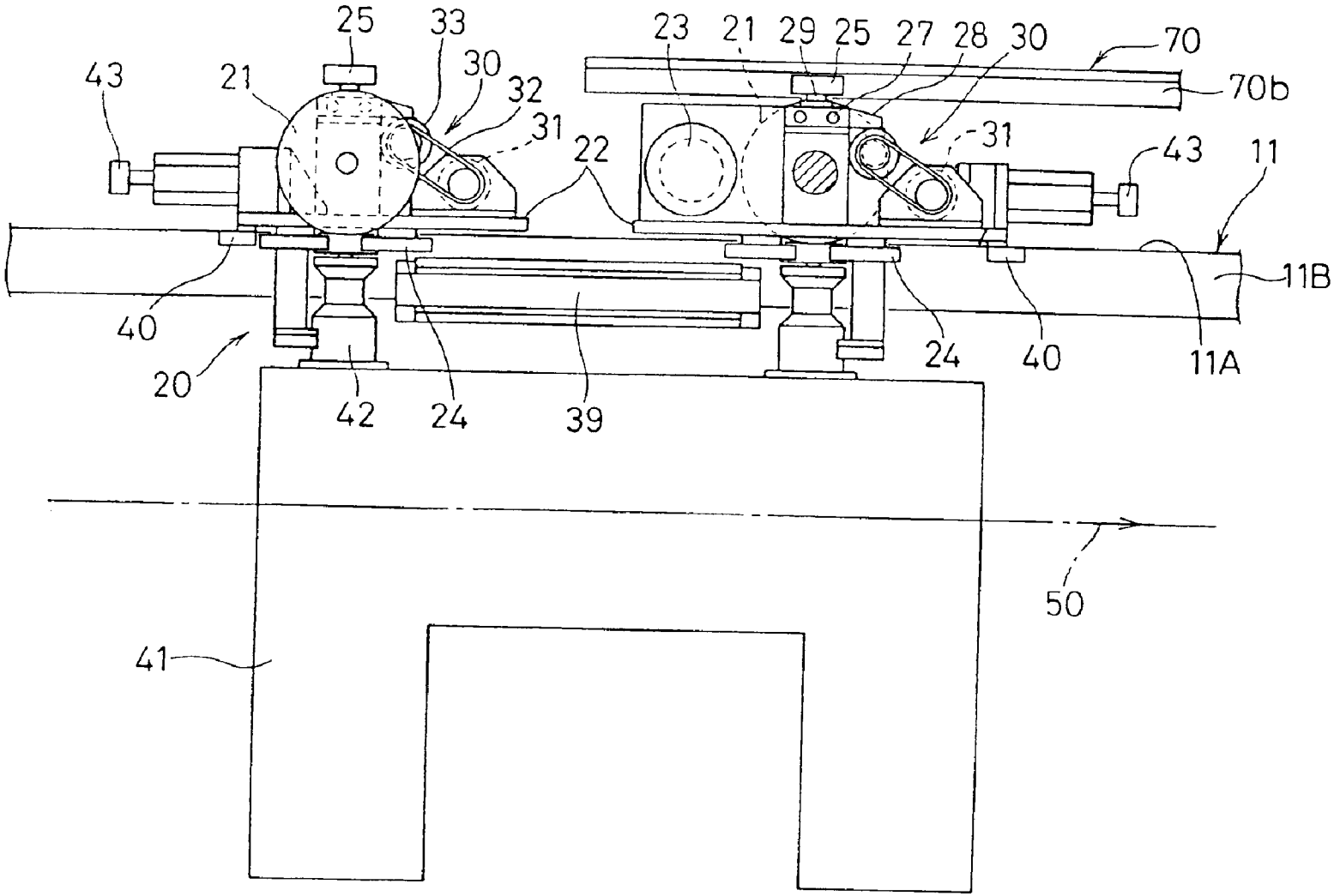
FIG. 13 is a partly cutaway side view of an essential part of the conveyance system.

In the above described third embodiment, the self-propelled member 20 cyclically runs on the fixed path 50 shaped like an endless ellipse. In this case, if a driving shaft of the travel driving device 23 includes no differential gear, when the self-propelled member runs along the curve of an arc path portion (loop end) 50*a* of the endless ellipse, the wheels 21 may slip due to a difference between the inner and outer wheels, resulting in a fricative sound. In this case, as shown in FIG. 12, when an arc-side guide member 72 used in the same manner as the fixed-path-side guide member 70 and the branching-and-joining-side guide member 71 is disposed along the arc path portion 50*a*, the self-propelled member 20 can run along the curve while causing either the inner or outer wheels to flow. Consequently, the wheels 21 can be restrained from slipping, thereby preventing a fricative sound.

Further, in a form in which a turn path portion 65 is branched and joined between a pair of linear path portions of the fixed path 50 (one or more locations) as shown in FIG. 12, when the turn path portion 65 is used to turn the self-propelled member 20, a short-cut travel is achieved, thereby reducing the time required for operations. Also in this case, a turn-side guide member 73 may be disposed along the turn path 65.

As shown by the above described third embodiment, when the driving system is arranged so that the rail members 11 (11*b*) and 12 (12*b*) have smaller cross sections and that the driving shafts of the wheels 21 and of the travel driving device 23 are at similar levels, the self-propelled member 20 requires a reduced height dimension and thus reduced spaces for travels, thereby allowing the apparatus to be installed more freely.

As shown by the above described third embodiment, the rail yokes 1, used to dispose the rail apparatuses 10 (10*b*) on the ceiling beam 2, not only act as installing members but also connect the lateral pair of rail members 11 (11*b*) and 12 (12*b*) together so as to cancel torsional moments generated in these rail members 11 (11*b*) and 12 (12*b*), thereby preventing the rail members 11 (11*b*) and 12 (12*b*) from being twisted.

As shown by the above described third embodiment, the rail members 11 (11*b*) and 12 (12*b*) have a simple and small cross section enough to form a minimum required area for the required functions. Thus, the rail members 11 (11*b*) and 12 (12*b*) can be bent easily for use. That is, the branching section 62, the joining section 63, the arc path portion 50*a*, and the turn path portion 65 require no exclusive rail members, and linear rail members can be bent according to the turning radius of the self-propelled member 20, thus substantially reducing costs.

As shown by the above described third embodiment, when only one direction restricting roller 25 is installed in the center of the trolley main body 22, the self-propelled member 20 may have a simple and compact structure. Further, the direction restricting roller 25 has a structure that moves in the lateral direction relative to the rail members 11 (11*b*) and 12 (12*b*), and loads are imposed on the direction restricting roller 25 in the same direction as the movement of the direction restricting roller 25. Consequently, during a travel, the direction restricting roller 25 is prevented from slipping out from the rail members 11 (11*b*) and 12 (12*b*).

Now, a fourth embodiment of the present invention will be described with reference to FIG. 20. FIGS. 20A to 20F show variations (layouts) of this embodiment of the present invention. Although the turn path 65 is omitted from FIGS. 20B to 10F, it may thus be omitted or provided at one or more locations.

Figure 20A:
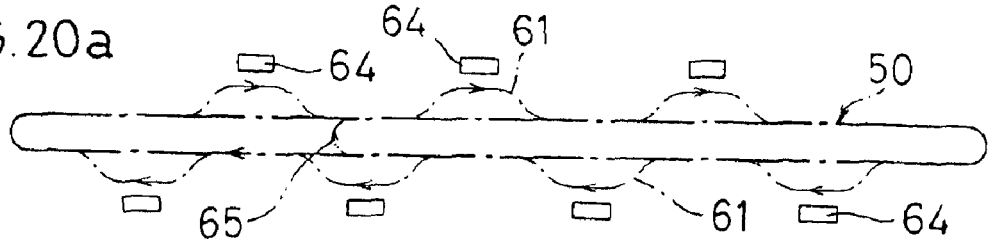
FIG. 20 is a schematic top view of a conveyance system according to a fifth embodiment of the present invention, FIGS. 20*a* to 20*f* showing variations of the embodiment.

FIG. 20A shows a form in which a plurality of branching-and-joining paths 61 are branched and joined to each of the two linear path portions of the endless fixed path 50 shaped like an ellipse.

Figure 20B:
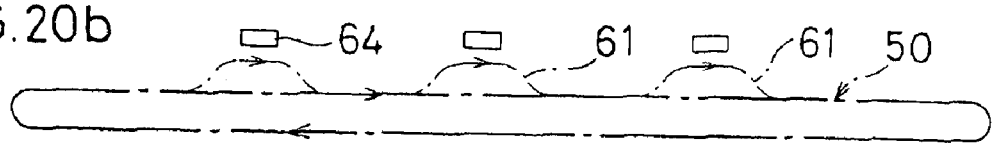

FIG. 20B shows a form in which a plurality of (a single) branching-and-joining paths 61 are branched and joined to only one of the two linear path portions of the endless fixed path 50 shaped like an ellipse.

Figure 20C:
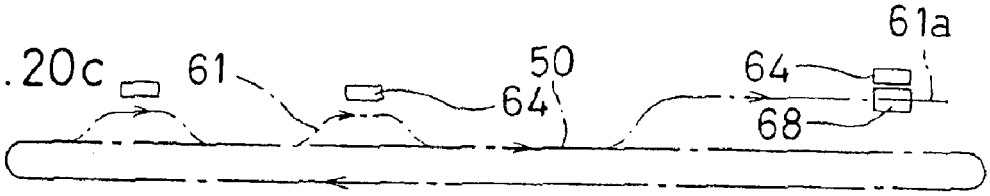

FIG. 20C shows a form in which an ended branching path 61*a* is branched from one (or both) of the linear path portions of the endless fixed path 50 shaped like an ellipse. In this case, when the self-propelled member 20 reaches a terminal of the branching path 61*a*, it is moved to another floor (upper or lower floor) by an elevating and lowering means (elevator) 68. The ended branching path 61*a* may be provided at a plurality of locations.

Figure 20D:
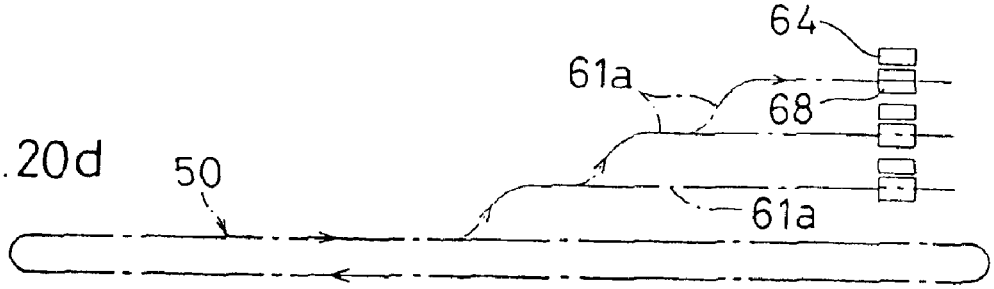

FIG. 20D shows a form in which an ended branching path 61*a* is branched from one (or both) of the linear path portions of the endless fixed path 50 shaped like an ellipse, and one or more branching paths 61*a* are sequentially branched from the above branching path 61*a*. The branching path 61*a* may be provided at a plurality of locations.

Figure 20E:
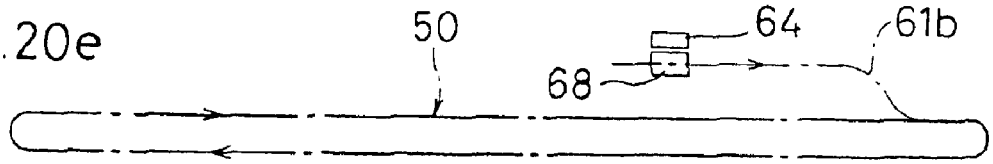

FIG. 20E shows a form in which an ended joining path 61*b* is joined to one (or both) of the linear path portions of the endless fixed path 50 shaped like an ellipse. In this case, the self-propelled member 20 from another floor (upper or lower floor) is moved to a start end of the joining path 61*b* by the elevating and lowering means (elevator) 68. The ended joining path 61*b* may be provided at a plurality of locations.

Figure 20F:
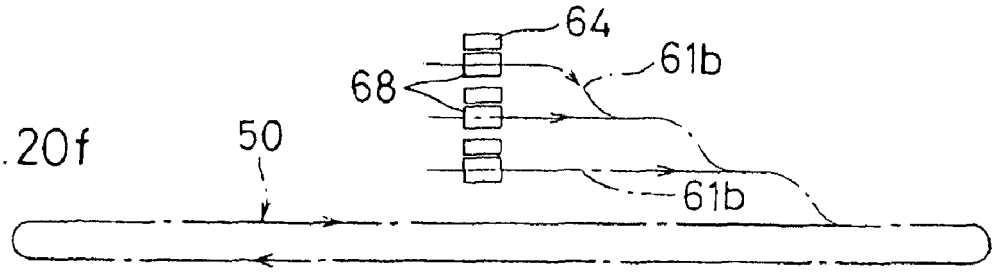

FIG. 20F shows a form in which an ended joining path 61*b* is joined to one (or both) of the linear path portions of the endless fixed path 50 shaped like an ellipse, and one or more ended joining paths 61*b* are sequentially joined to the above joining path 61*b*. The ended joining path 61*b* may be provided at a plurality of locations.

Since the rail apparatus 10 (10*a*) (10*b*) is composed of the lateral pair of rail members 11 (11*a*) (11*b*) and 12 (12*a*) (12*b*) as in the above described embodiments, it can form the space S along its entire length, and the vertical penetration portion formed by this space S allows air to flow without being hindered. Consequently, the present invention can be suitably used even for clean rooms, where clean air is blown downward.

In the above described embodiments, the moving body is shown as the self-propelled member 20, to which power is fed using the non-contact feeding method, but the self-propelled member 20 may use a contact feeding method. Alternatively, the moving body may be a truck to which moving force is applied by another driving device such as a driving chain. Furthermore, a linear motor driving form may be used to drive travels.

In the above embodiments, the form is shown in which the self-propelled member 20 has the holding device 41 hanging therefrom, but the holding device may, for example, be installed to stand from a truck (moving body) running on the floor (floor type).

In the above described embodiments, the guide surfaces constitute the guide sections 15*a*, 15*b* and 16*a*, 16*b* of the linear-side guide members 15 and 16, the guide sections 18*b* and 19*b* of the guide members 18 and 19 of the branching-and-joining-side guide member 17, the guide sections 70*a* and 70*b* of the fixed-path-side guide member 70, and the guide section 71*b* of the branching-and-joining-side guide member 71, and the direction restricting roller 25 constitutes the direction restricting member. However, the direction restricting member guided by the guide surfaces may be a slidable projection. Alternatively, a combination may be used in which the guide surfaces are rack surfaces, while the direction restricting roller 25 is a direction restricting pinion.

In the above described embodiments, the direction restricting roller 25 is moved in the lateral direction via the lateral-movement means 30 on the basis of the determination based on the detection of the detection target by the detector 40. However, a form may be used in which after the direction restricting roller 25 has passed through the branching-and-joining section, it is returned to its initial state (reset) on the basis of the detection of the detection target by the detector 40.

In the above described embodiments, the self-propelled member 20 has the holding device 41 hanging from between the trolley main bodies 22, and the lateral transfer means is disposed in the holding device 41. The holding device 41, however, may have vertical transfer means disposed therein. Alternatively, various forms may be employed in which the self-propelled member has a receiving table mounted thereon and on which articles are simply placed, and in which articles are directly placed on the self-propelled member.

What is claimed is:

1. A conveyance system, comprising rail apparatuses and moving bodies which are supported and guided by the rail apparatuses so as to move freely on a fixed path, wherein each of said rail apparatuses comprises a lateral pair of rail members each having an upward wheel supporting surface and an inward roller guide surface formed thereon, the fixed path comprises one or more linear path portions and a branching-and-joining path portion, a guide member is located at a branching-and-joining section formed by said path portion the guide member comprising a linear-side guide member extending along the linear path portion and a branching-and-joining-side guide member extending along the branching-and-joining path portion, the linear-side guide member and the branching-and-joining-side guide member each comprising a sideward guide sections, each of the moving bodies is provided with wheels supported and guided on said wheel supporting surface, side guide rollers guided on said roller guide surface, and each of the moving bodies comprises a pair of uniformly constructed direction restricting members located in a front and rear relationship in a longitudinal direction; and lateral-movement means to move the direction restricting members in a lateral direction, whereby the direction restricting members are moved laterally upstream of the guide members by the lateral-movement means and guided to one of (a) the sideward guide sections of the linear-side guide member, and (b) the branching-and-joining-side guide member.

2. The conveyance system according to claim 1, wherein the direction restricting member is guided by the liner-side guide members along the liner path portion and the branching-and-joining-side guide member along the branching-and-joining path portion, and is a direction restricting roller capable of enabling the moment of the self-propelled member to be accommodated.

3. The conveyance system according to claim 1, wherein each of the moving bodies comprises a longitudinal pair of trolley main bodies (22) having wheels (21) supported and guided on the wheel supporting surfaces (11A and 12A) and being free to roll thereon, and a pickup coil (39) provided between the trolley main bodies (22).

4. A conveyance system, comprising rail apparatuses and moving bodies which are supported and guided by the rail apparatuses so as to move freely on a fixed path, characterized in that:

the rail apparatuses each comprises a lateral pair of rail members disposed to form a space therebetween, the rail members being each formed with an upward wheel supporting surface and an inward roll guide surface;

in a branching-and-joining section leading to a branching-and-joining path which is branched and joined with respect to the fixed path, one of the lateral pair of rail members which is located on the side of the branching-and-joining path is severed to leave a space, said rail members located on the side of the branching-and-joining path disposed to be contiguous to each severed end;

said branching-and-joining section includes a fixed-path-side guide member extending along the fixed path and a branching-and-joining-side guide member extending along the branching-and-joining path, said fixed-path-side guide members and said branching-and-joining side guide member including respective sideward guide sections;

each of said moving bodies includes wheels supported and guided on said wheel supporting surface, side guide rollers guided on said roller guide surface, and a direction restricting member guided by the sideward guide sections of said guide members;

wherein said moving bodies include a lateral-movement means for driving the direction restricting member to move freely in a lateral direction between a location corresponding to the fixed-path-side guide member and a location corresponding to the branching-and-joining-side guide member; and the wheel on the side of the space floats over the wheel supporting surface when the direction restricting member is being guided by the guide members in the branching-and-joining section.

5. The conveyance system according to claim 4, wherein the wheel on the side opposite to the space is supported on the wheel supporting surface, and the direction restricting member is guided by the guide members, so that the moving body is inclined in the lateral direction to cause the wheel on the side of the space to float over the wheel supporting surface.

6. The conveyance system according to claim 5, wherein at least a portion of the guide member is formed to be thick enough to receive the moving body while inclining it in the lateral member.

7. The conveyance system according to claim 4, wherein the direction restricting member is guided by the liner-side guide members along the liner path portion and the branching-and-joining-side guide member along the branching-and-joining path portion, and is a direction restricting roller capable of enabling the moment of the self-propelled member to be accommodated.

8. A conveyance system, comprising rail apparatuses and moving bodies which are supported and guided by the rail apparatuses so as to move freely on a fixed path, wherein each of said rail apparatuses comprises rail members each having an upward wheel supporting surface and an inward roller guide surface formed thereon;

the fixed path comprises linear path portions and a branching-and-joining path portion;

a branching-and-joining section formed by said path portions are provided with linear-side guide members extending along the linear path portions and a branching-and-joining-side guide member extending along the branching-and-joining path portion;

linear-side guide members of both linear path portions each has a linear guide section formed outside a parallel portion of each said linear-side guide member and a branching-and-joining guide section formed inside the parallel portion;

the branching-and-joining-side guide member comprises a branching-side guide member and a joining-side guide member which are severed from each other, and a branching-side guide section and a joining-side guide section which are extended from the branching-and-joining-side guide member are formed to extend in different directions;

the moving bodies each include wheels supported and guided on said wheel supporting surface, side guide rollers guided on said roller guide surface, and a plurality of direction restricting members placed in a longitudinal direction and guided by sideward guide sections of said guide members, the direction restricting members being movable in a lateral direction between a location corresponding to the linear-side guide member and a location corresponding to the branching-and-joining-side guide member; and the branching-and-joining-side guide member has a severed section in which the direction restricting member moved along the branching-side guide section is guided to the joining-side guide section.

9. A conveyance system, comprising rail apparatuses and moving bodies which are supported and guided by the rail apparatuses to move freely on a fixed path, wherein the rail apparatuses each comprises rail members disposed to form a space therebetween, the rail members being each formed with an upward wheel supporting surface and an inward roll guide surface;

in a branching-and-joining section leading to said branching-and-joining path which is branched and joined with respect to the fixed path, one of the lateral pair of rail members which is located on the side of the branching-and-joining path is severed to leave a space, and the rail members on the side of the branching-and-joining path are disposed to be contiguous to each severed end;

the branching-and-joining section includes a fixed-path-side guide member extending along the fixed path and a branching-and-joining-side guide member extending along the branching-and-joining path;

each of said moving bodies includes wheels supported and guided on said wheel supporting surface, side guide rollers guided on said roller guide surface, and a direction restricting member guided by sideward guide sections of said guide members, the direction restricting member being movable in a lateral direction between a location corresponding to the fixed-path-side guide member and a location corresponding to the branching-and-joining-side guide member; and the wheel on the side opposite to the space is supported on the wheel supporting surface, and the direction restricting member is guided by the guide members, so that the moving body is inclined in the lateral direction to cause the wheel on the side of the space to float over the wheel supporting surface, when the direction restricting member is being guided by the guide members in the branching-and-joining section.

* * * * *